US011079195B2

(12) United States Patent
Silver et al.

(10) Patent No.: US 11,079,195 B2
(45) Date of Patent: Aug. 3, 2021

(54) FIREARM DISASSEMBLY/ASSEMBLY DEVICES AND METHODS

(71) Applicants: Lori Silver, Agoura Hills, CA (US); Joseph L. Pikulski, Westlake Village, CA (US)

(72) Inventors: Lori Silver, Agoura Hills, CA (US); Joseph L. Pikulski, Westlake Village, CA (US)

(73) Assignee: Lori Silver, Agoura Hills, CA (US)

( * ) Notice: Subject to any disclaimer, the term of this patent is extended or adjusted under 35 U.S.C. 154(b) by 0 days.

(21) Appl. No.: 16/660,706

(22) Filed: Oct. 22, 2019

(65) Prior Publication Data

US 2021/0116203 A1 Apr. 22, 2021

(51) Int. Cl.
*F41A 23/18* (2006.01)
*F41A 11/00* (2006.01)

(52) U.S. Cl.
CPC ..... *F41A 23/18* (2013.01); *F41A 11/00* (2013.01)

(58) Field of Classification Search
CPC ..... F41A 23/18; F41A 11/00
USPC ..... 42/108
See application file for complete search history.

(56) References Cited

U.S. PATENT DOCUMENTS

| | | | | |
|---|---|---|---|---|
| 2,741,011 | A * | 4/1956 | Kuper | F41A 7/02 42/108 |
| D203,680 | S | 2/1966 | Allison | |
| 4,438,913 | A | 3/1984 | Hylla | |
| 5,050,331 | A | 9/1991 | Burkhalter | |
| 7,886,474 | B2 | 2/2011 | Werner | |
| 8,578,645 | B2 | 11/2013 | Cauley | |
| 8,727,294 | B1 | 5/2014 | Harms | |
| 9,616,552 | B1 | 4/2017 | McClain | |
| 2008/0127815 | A1* | 6/2008 | Yale | F41C 33/06 89/37.01 |
| 2011/0173868 | A1* | 7/2011 | Wilson | F41A 23/18 42/95 |
| 2012/0222344 | A1 | 9/2012 | Werner | |
| 2012/0255212 | A1 | 10/2012 | Werner | |

OTHER PUBLICATIONS

Drawings of the 1911-A1 Model Government Pistol, 2004, pp. 1-56.
M1911-A1 Redux, Rio Benson, Consulting, LLP, 2010, pp. 1-59.
Springfield Armory 1911-A1 Pistols Operation and Safety Manual, 2013, pp. 1-64.

* cited by examiner

*Primary Examiner* — Bret Hayes
(74) *Attorney, Agent, or Firm* — Ferguson Case Orr Paterson

(57) ABSTRACT

The present disclosure describes devices and methods for disassembly and/or reassembly of firearms. The devices can include mechanisms such as a crank mechanism, guide rails, and stop plate to enable simplified disassembly and reassembly of a firearm.

20 Claims, 29 Drawing Sheets

400'
467
449
475
476
451
479'
447
442b
469
442a
461
400
479
469

FIREARM DISASSEMBLY/ASSEMBLY DEVICES AND METHODS

BACKGROUND

1. Field of the Disclosure

The present disclosure relates to devices and methods for disassembling a firearm, such as for cleaning, and for reassembling the firearm.

2. Description of the Related Art

FIGS. 1A-1G show various perspective views of a prior art handgun or firearm 10 during various stages of disassembly, with FIGS. 1A and 1B showing the firearm 10 in its fully assembled state. The firearm 10 includes a frame 40, a slide 20 (including a rear sight 22 and front sight 24), and a slide lock 46 attached to the frame 40. The slide lock 46 is shown detached in FIGS. 1F and 1G, and includes a slide lock lever 46*a* and a slide lock pin 42. The slide 20 is shaped to define a slide catch 30 and a slide lock release position notch 32. The slide 20 can be pulled backward relative to the frame 40 (and/or the frame 40 pushed forward relative to the slide 20) and the slide lock lever 46*a* rotated to engage the slide catch 30, as shown in FIG. 1C. While the front of the barrel 62 is exposed regardless of the position of the slide 20, backward movement of the slide 20 exposes an additional portion of the barrel 62.

Typical disassembly of the firearm 10 can be dangerous due to the spring action of the firearm 10, and/or can be difficult to complete due to the hand strength and dexterity required. For instance, in one disassembly method, a user must both support the firearm 10 while also holding the slide 20 in an open/rearward position, all with one hand, in order to complete other operations with the other hand. For instance, as shown in FIG. 1C, a user must apply force F1 to pull the slide 20 backward and continue to apply the force F1 to hold the slide 20 in a backward position, while also applying the force F3 to move the slide lock 46 to a position where it engages the slide catch 30. With the slide 20 biased forward, this can be difficult, especially for those with smaller hands and/or a disability.

In FIGS. 1D and 1E, a takedown device 66 is placed on the spring rod 64, securing the spring assembly 72 (seen in FIG. 1G). In FIG. 1E, since the spring assembly 72 has been secured, the slide lock 46 can be removed from the slide catch 30 and the slide 20 will move slightly forward. Once the slide lock 46 is aligned with and/or placed into the slide lock release position notch 32 (as shown in FIGS. 1E and 1F), the slide lock pin 42 (part of the slide lock 46) can be removed from the slide lock through-hole 44 rest of the firearm 10 using a force F5. With the slide lock 46 removed, the remainder of the firearm 10 can be disassembled as shown in FIG. 1G.

Reassembly generally occurs in the reverse order. However, in order to attach the slide lock 46 to the remainder of the firearm 10, the barrel link 68 shown in FIG. 1G (which rotates about a barrel link pivot pin 77) must be properly aligned for insertion of the barrel link 46, which can be difficult to achieve.

In light of the above complicated procedures which can require great dexterity and strength for what should be the simple task of breaking down a firearm, the present disclosure relates to devices and methods for disassembling the firearm 10 that generally require less hand strength and dexterity.

SUMMARY OF THE DISCLOSURE

Some embodiments of the present disclosure are directed toward devices and methods for disassembly and/or reassembly of firearms. Some embodiments can include mechanisms such as, a crank mechanism, guide rails, and stop plate to enable simplified disassembly and reassembly of a firearm. Other embodiments are possible.

One embodiment of a firearm disassembly and/or reassembly device according to the present disclosure includes a base with first and second guiderails on the base. A crank device is also included on the base. The crank device can include a crank, a push mechanism, and a crank shaft between the crank and the push mechanism. The crank is operable to move the push mechanism toward or away from the first and second guiderails.

One embodiment of a device for aiding in disassembly of a firearm according to the present disclosure includes a base and a stop plate on an end of the base. A first connector connects the stop plate to the end of the base. The stop plate is shaped to define an aperture and configured to abut a slide of a firearm while allowing another portion of the firearm to pass through the aperture when a force is applied to the rear of the firearm and toward the stop plate.

One embodiment of a method for disassembling a firearm, the firearm including a frame and a slide according to the present disclosure, includes placing the firearm in an inverted position on a base such that the slide is between first and second guiderails that are on a top side of the base. Forward pressure is applied to a back end of the firearm. The slide comprises a forward end that is maintained against a stopper such that the slide is maintained behind the stopper despite the forward pressure, while the forward pressure moves the frame forward.

The above summary has broadly outlined some features and technical advantages of the present disclosure in order that the detailed description that follows may be better understood. Additional features and advantages of the disclosure will be described below. It should be appreciated by those skilled in the art that this disclosure may be readily utilized as a basis for modifying or designing other structures for carrying out the same or similar purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further objects and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Disclosed herein are devices and methods for the disassembly and reassembly of firearms. Many embodiments of these devices can use crank or similar mechanisms that can both move various parts of the firearm and hold those parts of the firearm in place, leaving the user with two free hands to perform other operations.

It is understood that when an element is referred to as being "on" another element, it can be directly on the other element or intervening elements may also be present. Further, when one element is referred to as being "connected" to another element, it can be directly connected to the other element or intervening elements may also be present as would be understood by one of skill in the art. Furthermore, relative terms such as "inner", "outer", "upper", "top", "above", "lower", "bottom", "beneath", "below", and similar terms, may be used herein to describe a relationship of one element to another. Terms such as "higher", "lower", "wider", "narrower", and similar terms, may be used herein to describe angular and/or relative relationships. It is understood that these terms are intended to encompass different orientations of the elements or system in addition to the orientation depicted in the figures.

Although the terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present disclosure.

Embodiments of the disclosure are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the disclosure.

Device Componentry

Figure 1A:
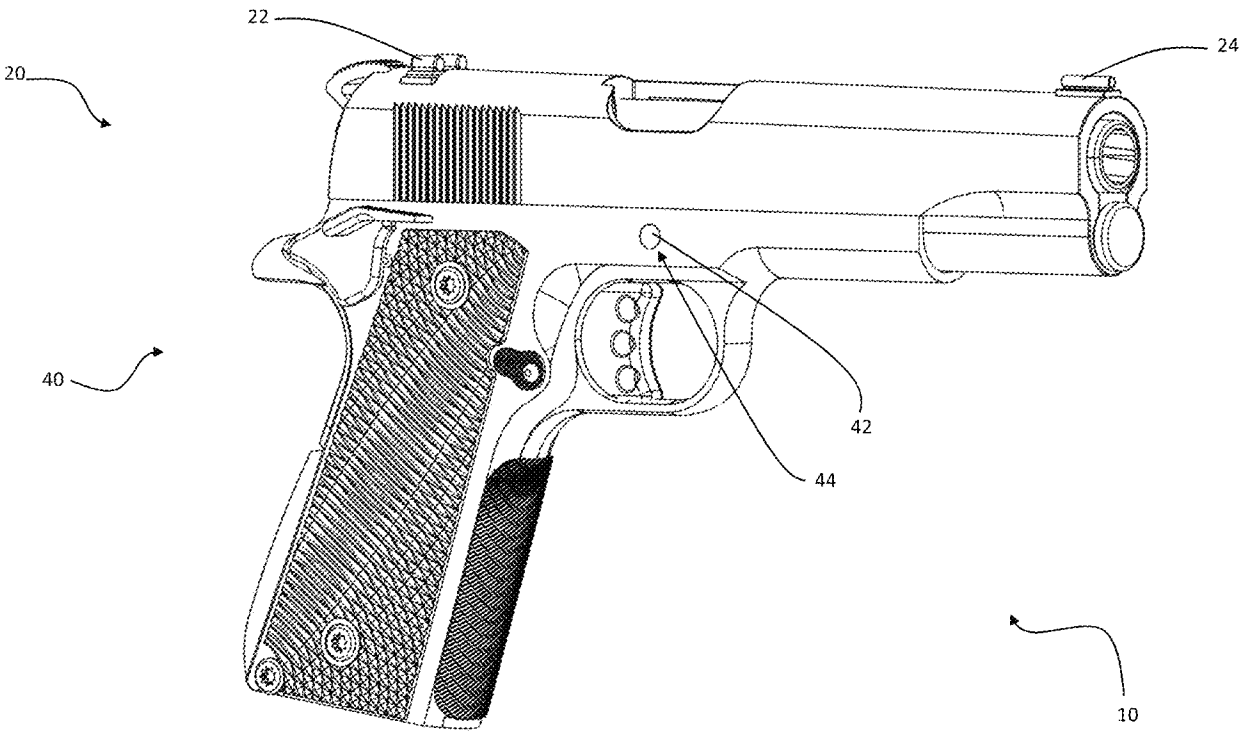
FIG. 1A PRIOR ART
FIGS. 1A and 1B are right side perspective and left side perspective views, respectively, of a prior art firearm.
Figure 1B:
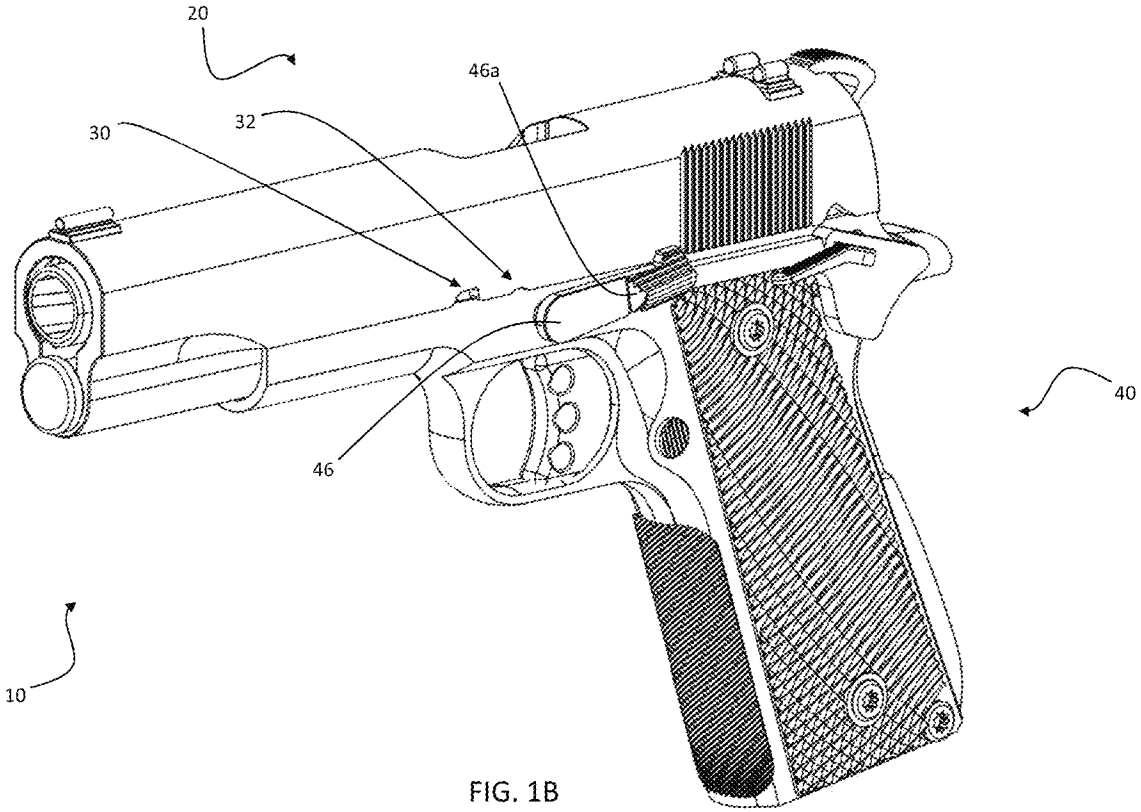
FIG. 1B PRIOR ART
Figure 1C:
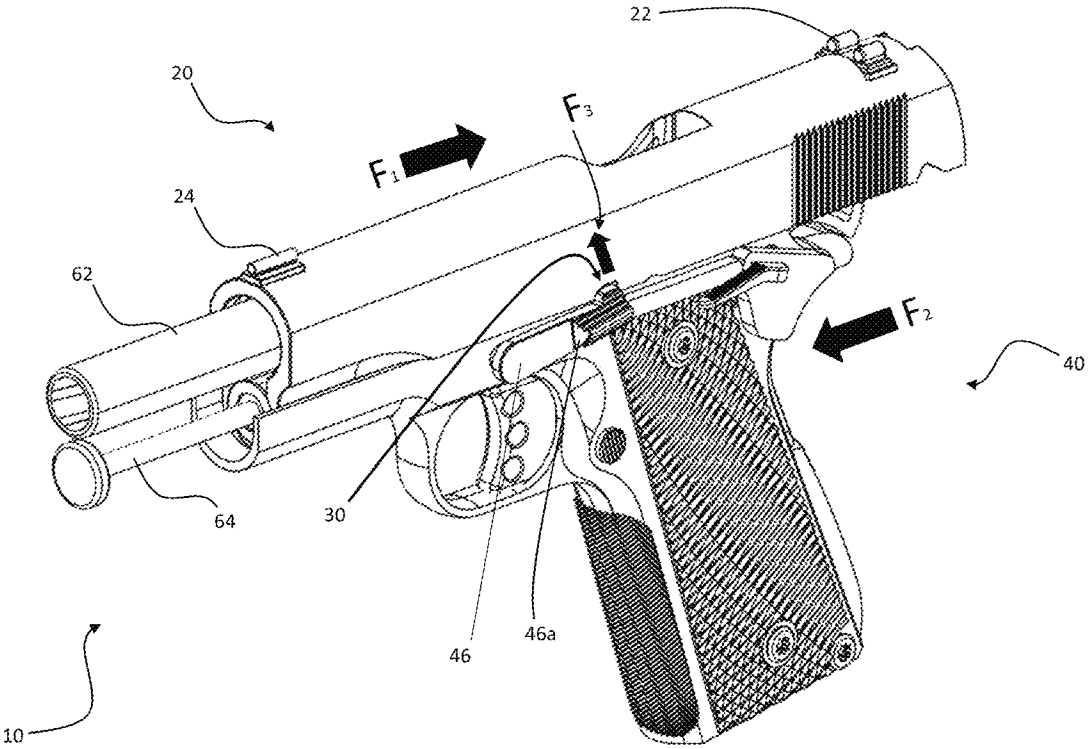
FIG. 1C PRIOR ART
FIGS. 1C-1G are left side perspective views of the firearm from FIGS. 1A and 1B in different states of disassembly/assembly.
Figure 1D:
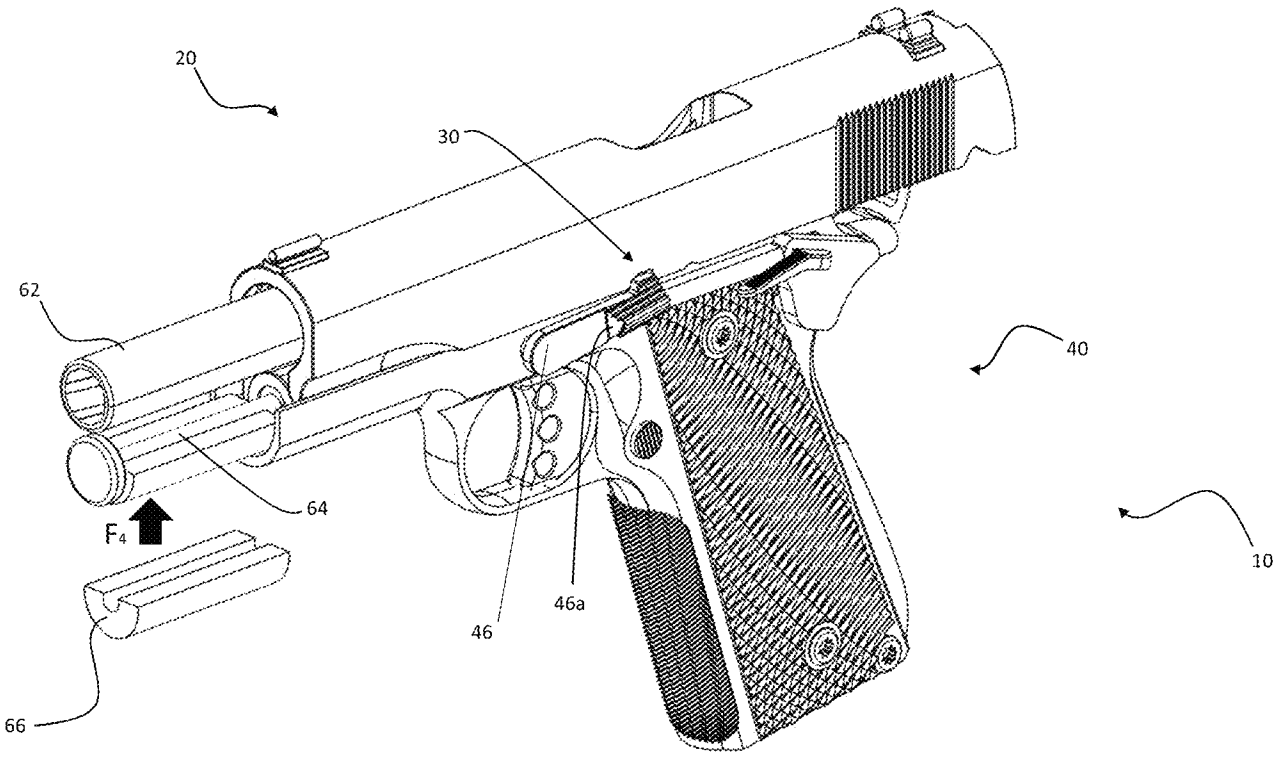
FIG. 1D PRIOR ART
Figure 1E:
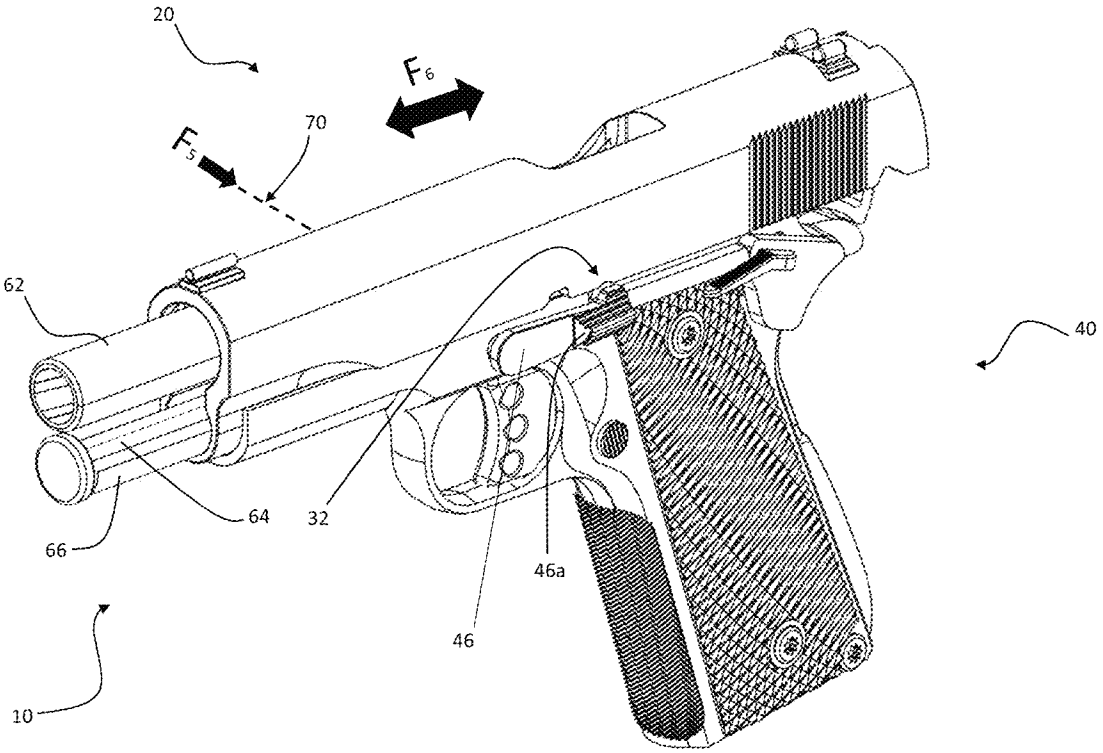
FIG. 1E PRIOR ART
Figure 1F:
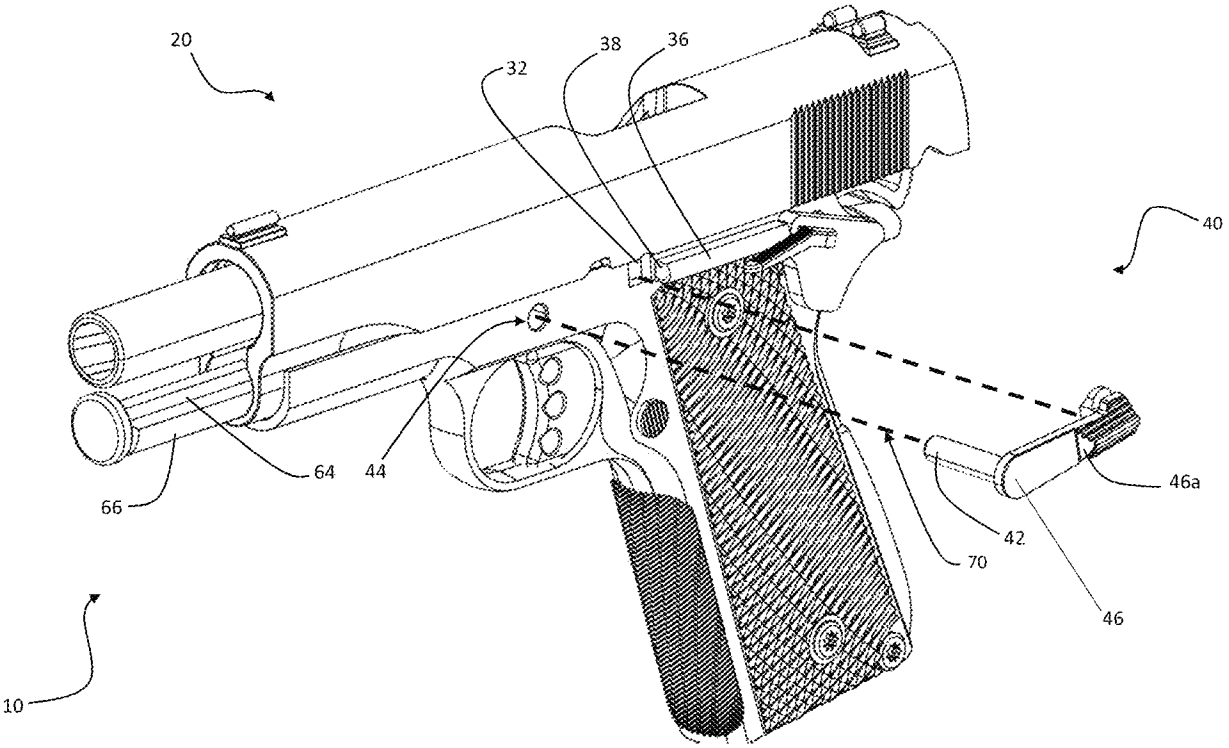
FIG. 1F PRIOR ART
Figure 1G:
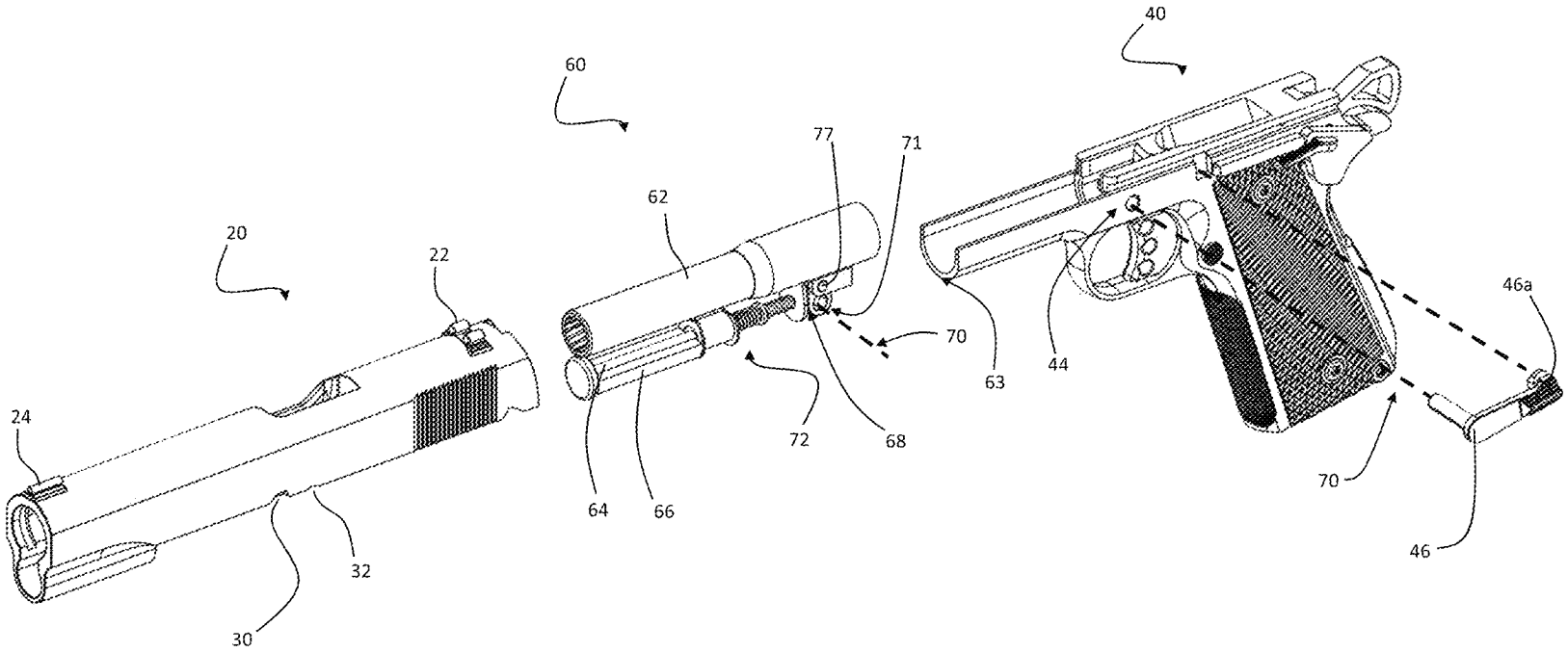
FIG. 1G PRIOR ART
Figure 2A:
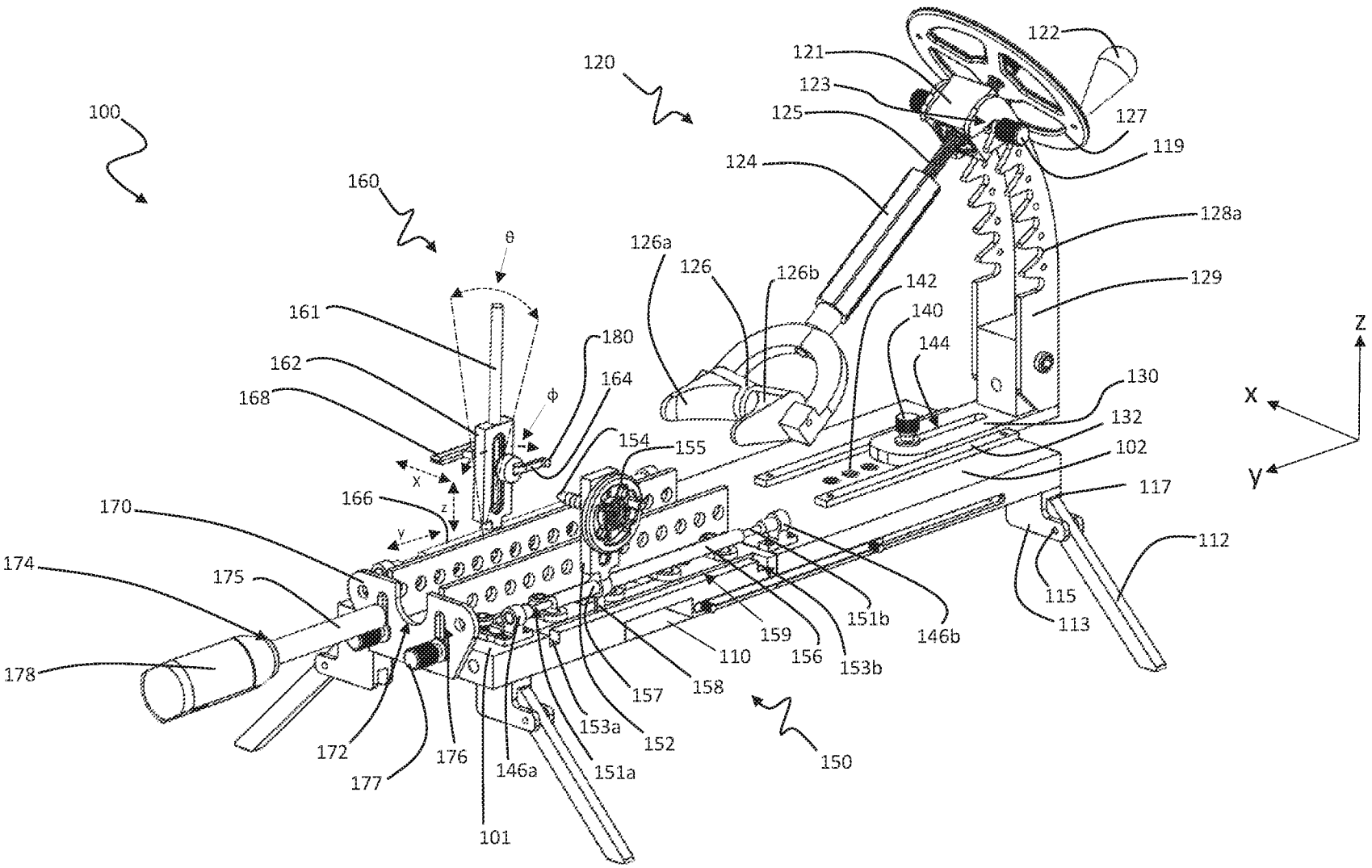
FIGS. 2A and 2B are perspective views of a firearm disassembly and/or reassembly device according to one embodiment of the present disclosure.
Figure 2B:
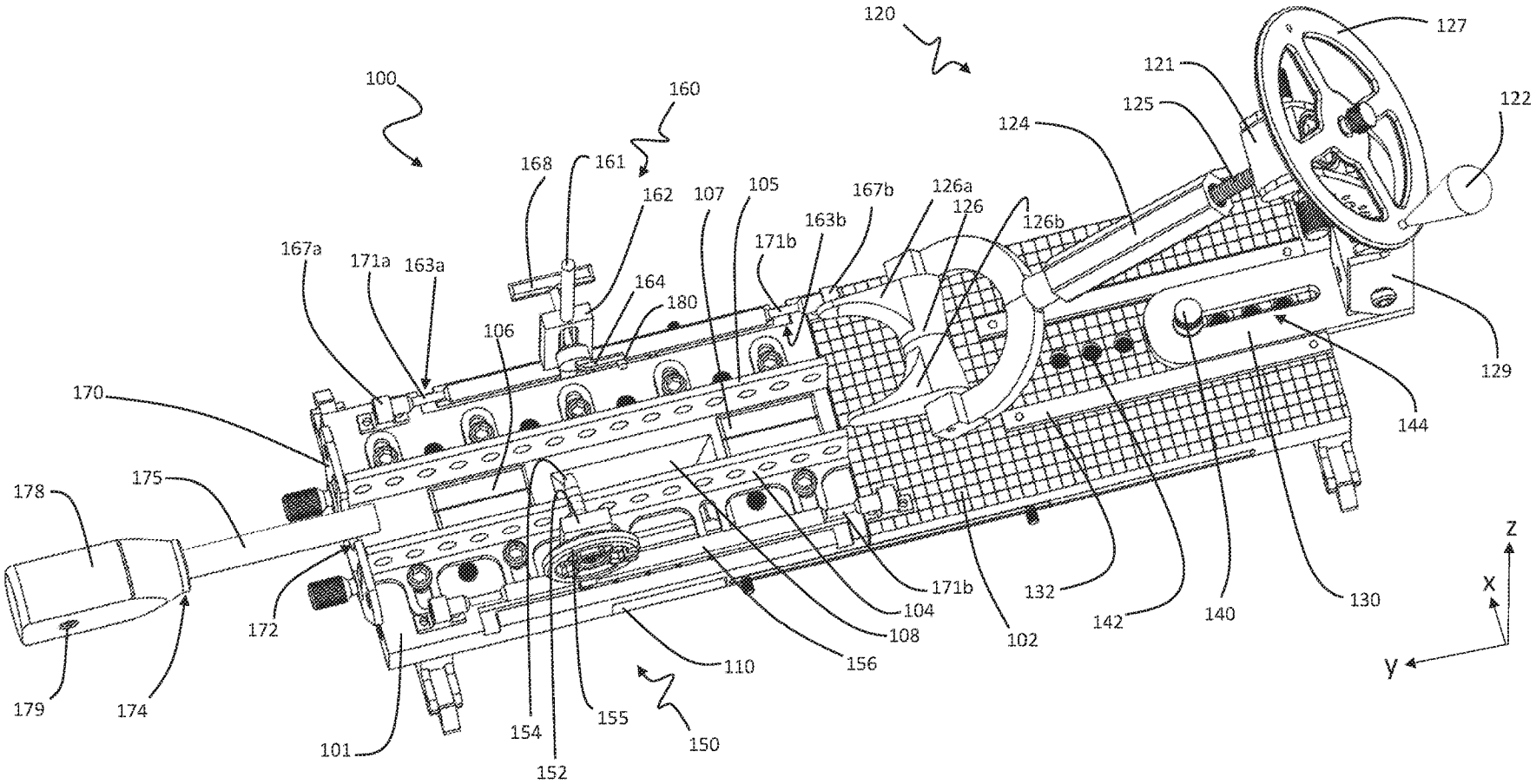
Figure 3A:
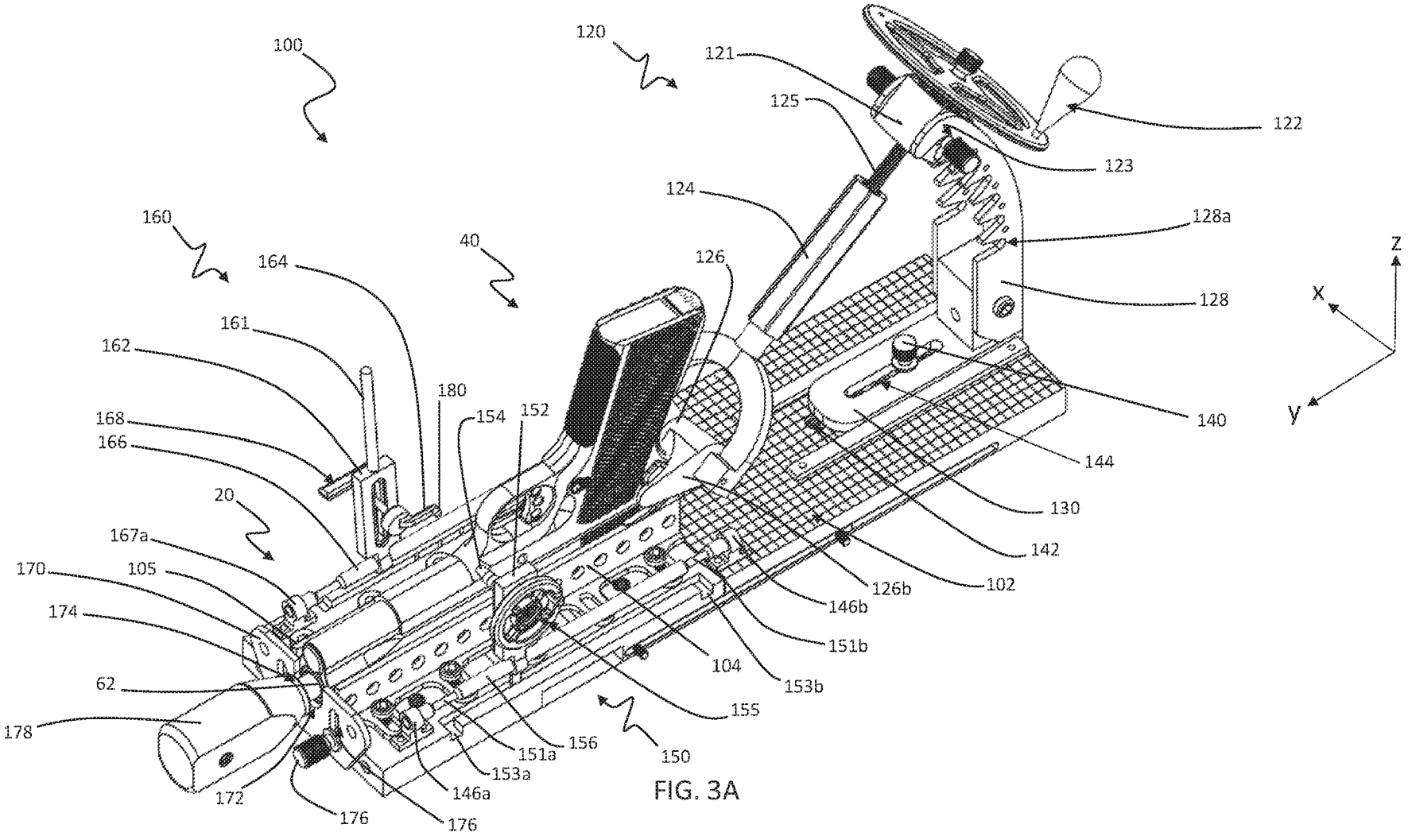
FIGS. 3A-3C are perspective views of the device from FIGS. 2A and 2B in combination with the firearm from FIGS. 1A-1G.
Figure 3B:
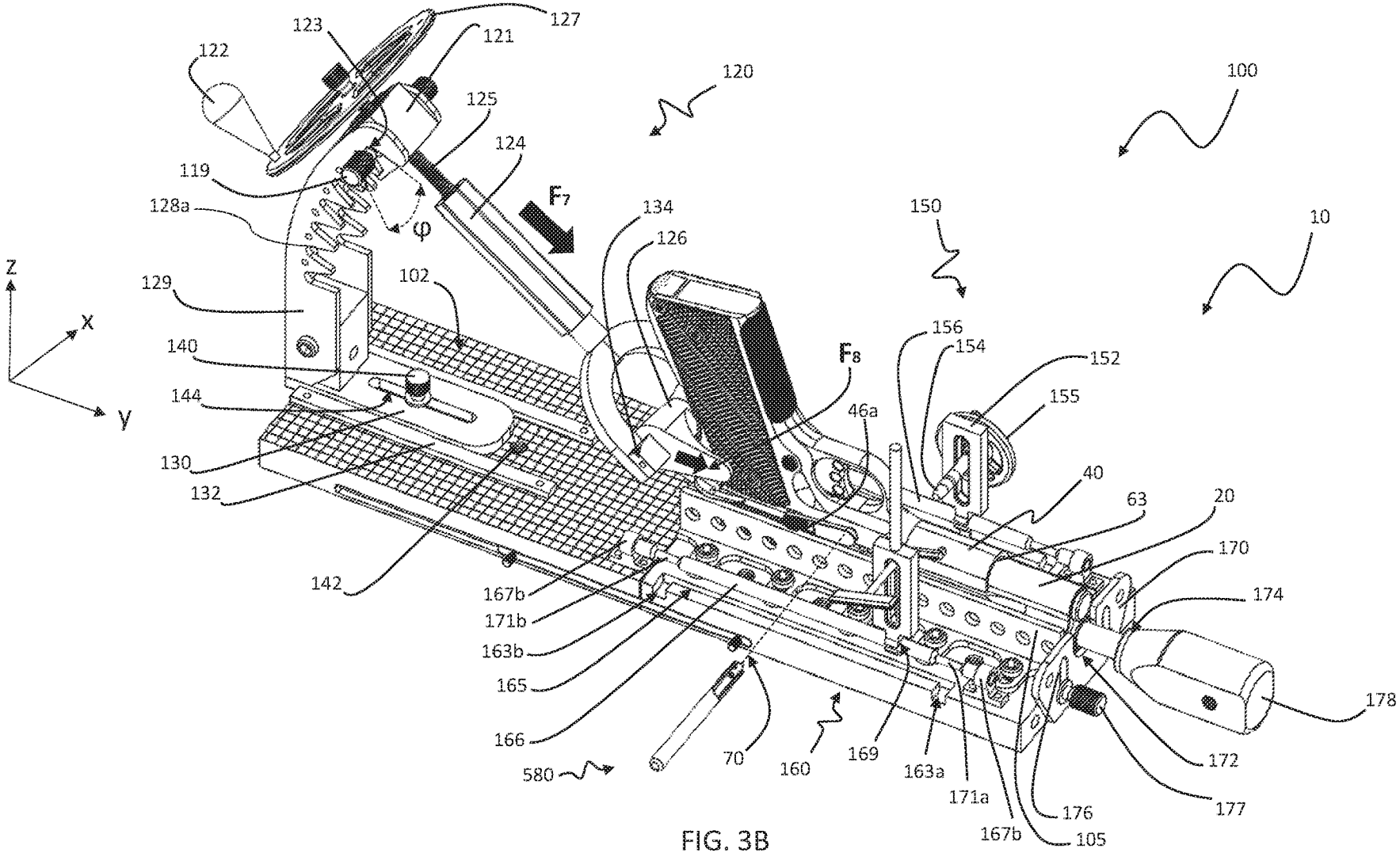

FIGS. 2A and 2B show a firearm disassembly and/or reassembly device 100, with FIGS. 3A and 3B showing the device 100 in combination with a firearm 10. Generally speaking, movements and/or orientations of different parts of the device 100 can be described as being in the x, y, and/or z direction, as shown in the figures. The y direction is along the length of the device 100 and parallel to the direction of the firearm 10, the x direction is along the width of the device 100 and transverse to the direction of the firearm 10, and the z direction is along the height of the device 100. As used herein, when a movement or orientation is described as being linear in nature, it is parallel to the y direction or the x direction, with "along the device 100" referring to the y direction and "across the device 100" referring to the x direction. As used herein, "linear" along the y and/or x direction can also include a non-zero z component. For instance, the crank shaft 125 (to be described in more detail below) is linear in the y direction. Elements that are all linear in the y direction (or alternatively all linear in the x direction) are described herein as being parallel to one another, while two elements that are respectively in the y direction and the x direction are described herein as being perpendicular to one another, regardless of any non-zero z components. "Forward" and similar terms as used herein refer to movement in the direction from the grip of the firearm 10 (FIG. 3A) toward the barrel end of the firearm 10, and "rearward," "backward," and similar terms as used herein refers to movement in the direction from the barrel end of the firearm 10 toward the grip of the firearm 10.

The device 100 can include a base 102, with first and second guiderails 104, 105 on the base 102, such as on the top surface of the base 102 as shown. As shown in FIGS. 3A-4C, the first and second guiderails 104,105 can be configured and/or spaced so as to hold the inverted firearm 10 therebetween, with the base 102 thereunder. The first and second guiderails 104, 105 are substantially parallel to each other and run in the y direction, such that the inverted firearm 10 can be placed therebetween and oriented in the y direction.

The device 10 can also include a crank assembly 120. The crank assembly 120 can include a crank handle 122, a push mechanism 126, and a crank shaft 125 between the crank 122 and the push mechanism 126. Other components can include a crank shaft coupling 124 and a drive mechanism 121. It is understood that additional elements can be included between any of the elements discussed or shown. The crank assembly 120 can also include a crank stand 128 and a crank base 130, which can be on the base 102, such as the topside thereof as shown. The crank stand 128 can connect the crank base 130 to the crank shaft 125.

The crank assembly 120 can be attached to the base 102 by one or more connectors 140, with the specific embodiment of the device 100 shown including a single connector 140. As shown, the connector 140 connects the crank base 130 to the base 102. Connectors according to the present disclosure can be of any variety known in the art, with the specific connector 140 shown being a screw connector. The device 100 can also include one or more crank base guides, such as the crank base guides 132, which can assist with proper positioning of the crank base 130. As shown, the crank base guides 132 run parallel to one another in the y direction, with the crank base 130 therebetween.

The use of a non-permanent connector, such as the screw connector 140, can be advantageous in that it can allow for the position of the crank base 130 to be adjusted relative to the base 102. This can be particularly useful for using the device 100 with different sizes of firearms. In some embodiments, the connector 140 can simply be tightened against the base 102. In the embodiment shown, the base 102 includes connector apertures 142, and the connector 140 can be placed into any one of the connector apertures 142 to provide further stability. Adjustment of the position of the crank base 130 can be achieved in one or more ways. For instance, in the embodiment shown the crank base 130 includes a crank base aperture 144, which in this case is a linear aperture. With the connector 140 removed or loosened, the crank base 130 can be slid forward or rearward, and the connector 140 can then be reconnected or tightened so as to connect the crank base 130 to the base 102. For instance, in FIGS. 2A and 2B the connector 140 is shown in a first position relative to the crank device 122 and crank base 130 such that the crank device 122 is further back. On the other hand, FIGS. 3A and 3B show the connector in a second position relative to the crank device 122 and crank base 130, such that the crank device 122 is further forward. Additionally, or in place of this functionality, the connector 140 can be placed in different apertures of the connector apertures 142. For instance, in embodiments where the position of the connector 140 is not adjustable relative to the crank base 130, the crank base 130 and connector 140 can be repositioned such that the connector 140 connects to a different connector aperture 142. The device 100, as shown, includes the combination of these two functionalities. Other embodiments are possible.

In some embodiments of the disclosure, such as that shown in FIGS. 2A-3B, the angle of the crank shaft 125 is also adjustable. For instance, in the device 10, the crank stand 128 includes two or more indexing positions 128*a* to which the crank shaft 125 can connect. In the position shown, the crank shaft 125 is connected to the highest indexing position 128*a* and takes the steepest angle from the crank stand 128 to the push mechanism 126. However, the crank shaft 125 can be adjusted to be connected to one of the lower indexing positions 128*a* so as to take a flatter angle. The adjustability of the crank shaft angle provides for greater user customization and comfort. In the specific embodiment shown, the indexing positions 128*a* are accomplished using a sawtooth pattern with each sawtooth aperture corresponding to an indexing position 128*a*. Other embodiments are possible. Additionally, embodiments where the crank shaft 125 can connect to the crank stand 128 over a continuous range of positions are also possible. For example, in one such embodiment, one or more connectors such as screws are used to secure the position of the crank shaft 125.

The push mechanism 126 can include shoulders 126*a* which extend in a forward direction. These shoulders 126*a* can help to stabilize the firearm 10 when the device is in operation by wrapping around the rear of the grip of the firearm 10, which helps prevent tilting of the firearm 10.

The device 100 can include a plunger device 150, which can include a plunger stand 152 and a plunger 154. In the embodiment shown, the plunger device 150 also includes a plunger rail 156 with a front 151*a* and rear 151*b*. The plunger stand 152 can be attached to the plunger rail 156 using a circular aperture 157, which can attach to the plunger rail 156 in many different ways, such as sliding onto a rail end or being snap fit. Optionally, a cam track tab 158 can be below the circular aperture 157, and can ride in a cam track 159 in order to stabilize the movement. The plunger stand 152 can be rotatable between an upright position as shown in FIGS. 2A-3B, and a downward position, such as a position where the plunger stand 152 is substantially horizontal, or a position where the plunger stand 152 is short of horizontal but no longer vertical, or to a position where the plunger stand 152 is past horizontal. In the specific embodiment shown, the plunger stand 152 is rotatable about the plunger rail 156, though it is understood that the plunger stand 152 can rotate about other elements and/or be rotatable from a top of the base 102, or in some embodiments can be non-rotatable. The optional plunger rail 156 runs lengthwise, such that the lengthwise position of the plunger stand is adjustable along the plunger rail, which can be helpful when the device 100 is used with firearms of different sizes.

The plunger device 150 also includes the plunger 154. In some embodiments, the plunger 154 is static in nature, and simply moves with the plunger stand. In other embodiments, the plunger 154 is movable relative to the plunger stand 152. For instance, in the specific embodiment shown, the plunger 154 is movable via a plunger crank 155, such that the plunger 154 can move between an advanced position and a withdrawn position.

The device 100 can also include a slide lock operation device 160. The slide lock operation device 160 can include a slide lock operation device stand 162 and a slide lock operation device rail 166, which can operate in the same manner as, or a similar manner to, the operation of the plunger stand 152 and plunger rail 156, respectively. Instead of a plunger 154, which moves across the base 102, the slide lock operation device 160 includes a slide lock rotator 164. The slide lock rotator 164 can rotate in the directions shown in FIG. 2A, and/or in a plane parallel to the y-z plane. In the specific embodiment shown, the slide lock rotator 164 can be operated manually by the T-handle 168, though it is understood that other methods of operation are possible. The slide lock rotator 164 can be moved up and down within the stand 162 in some embodiments, such as via an aperture, and can rotate up to 360° in some embodiments.

A stopper such as a stop plate 170 (hereinafter referred to as a "stop plate" for simplicity, though it is understood that other stoppers are possible) can be included opposite the crank assembly 120. For instance, in the embodiment shown, the stop plate 170 is at or near an end of the base 102. The stop plate 170 can be shaped to define an aperture 172, such that the stop plate 170 as a whole is shaped to abut the slide 20 of the firearm 10 without blocking the barrel 62 of the firearm 10. The position of the stop plate 170 can be adjustable, such as vertically adjustable. For instance, its position can be adjusted utilizing one or more fasteners 177 in conjunction with alignment fastener apertures 176. Other embodiments are possible. The aperture 172 can be substantially U-shaped as shown, and/or can include a substantially circular portion on its bottom and a substantially rectangular portion thereabove. The width of the aperture 172 can be, for example, ⅛" or greater, ¼" or greater, ½" or greater, ¾" or greater, 1" or greater, or 5" or smaller, or 3" or smaller, or 2" or smaller, or 1.5" or smaller, or 1.25" or smaller, or 1" or smaller, or ¾" or smaller, or in any range of these dimensions (e.g. ⅛" to 2", ¼" to 1.5", ½" to 1", or other ranges). These dimensions are exemplary only and other dimensions are possible.

As best seen in FIG. 2B, the device 100 can also include a front site elevation pad 106 and a rear site elevation pad 107. These pads can serve to protect the front and rear sites 24,22. Additionally, cartridge apertures 108,110 (which can be connected to one another) can also be included. If a cartridge has been left in the chamber prior to insertion of the firearm 10 into the device 100, the cartridge may be removed while the firearm 10 is in the device 100, and the cartridge apertures 108,110 provide an exit point for that cartridge.

The device 100 can also include tripod legs 112 as best seen in FIG. 2A, which can fold under the base 102. In order to allow both for folding capability and longer tripod legs 112, opposing pairs of legs can be slightly offset such that they can overlap when in a folded position under the base 102.

Firearm Disassembly

One method of operating a device according to the present disclosure, such as the device 100, is described hereafter. It is understood, however, that the device 100 and similar devices can be operated in variations of this method as would be understood by one of skill in the art based upon the present disclosure. For instance, certain steps can be omitted, and conventional and/or optional steps not described can be included.

In a method according to the present disclosure, the firearm 10 is placed in an inverted position in the device 100 as shown in FIGS. 3A and 3B. The firearm 10 is placed such that the top of the firearm 10 is on the base 102 and/or some intervening element, and between the guiderails 104,105, and the front of the firearm 10 is against the stop plate 170. An alignment tool 178 including a barrel insert 175 can be used to ensure that the firearm 10 is properly aligned in the device. For instance, the firearm can be placed in an inverted position between the guiderails 104,105 with the front thereof abutting the stop plate 170, and the barrel insert 175 of the alignment tool 178 can be placed through the stop plate aperture 172 and into the barrel 62 so as to ensure the firearm 10 is properly aligned. The alignment tool 178 can include a reference surface 174 that is sized so as to abut the barrel 68 of the firearm 10, but not the slide 20; and/or is sized to closely fit into the stop plate aperture 172.

Once the firearm 10 is properly aligned, the crank assembly 120 can be adjusted such that the push mechanism 126 is in contact (direct or otherwise) with the rear of the firearm 10, such as the rear of the frame 40. The push mechanism 126 can be placed above the slide 20, since the slide 20 is to be held relatively stationary in this embodiment. The push mechanism 126 can be placed low enough so as to have proper leverage on the firearm 10, such as within one inch of the slide 20, and/or within a half inch of the slide 20, and/or within one inch of the top of the guiderails 104,105, and/or within a half inch of the top of the guiderails 104,105.

Generally, the positioning of the crank base 130 can be used for larger positional adjustments of the push mechanism 126 ("macro-adjustment"), while the operation of the crank 122 can be used for smaller positional adjustments of the push mechanism 126 ("micro-adjustment"). However, it is understood that operation of the crank 122 alone can sometimes achieve the necessary positional adjustments.

In one embodiment, the position of the crank base 130 is adjusted as previously described such that the push mechanism 126 is near or in contact with the rear of the firearm 10. Then, the crank 122 is operated in a first rotational direction that, through the crank shaft 125, moves the push mechanism 126 forward. As the crank 122 is operated, once the push mechanism 126 makes contact with the rear of the firearm 10, the push mechanism 126 applies forward pressure to the rear of the firearm 10. The slide 20 of the firearm 10 abuts the stop plate 170, and thus does not move forward. However, because the stop plate 170 does not block the frame 40 and/or barrel 62 of the firearm 10, the forward pressure applied by the push mechanism 126 pushes those elements forward. The forward pressure can reorient the firearm to the position of the firearm 10' shown in FIGS. 4A and 4B, where the frame 40, barrel 62, and spring rod 64 have been pushed forward.

Figure 3C:
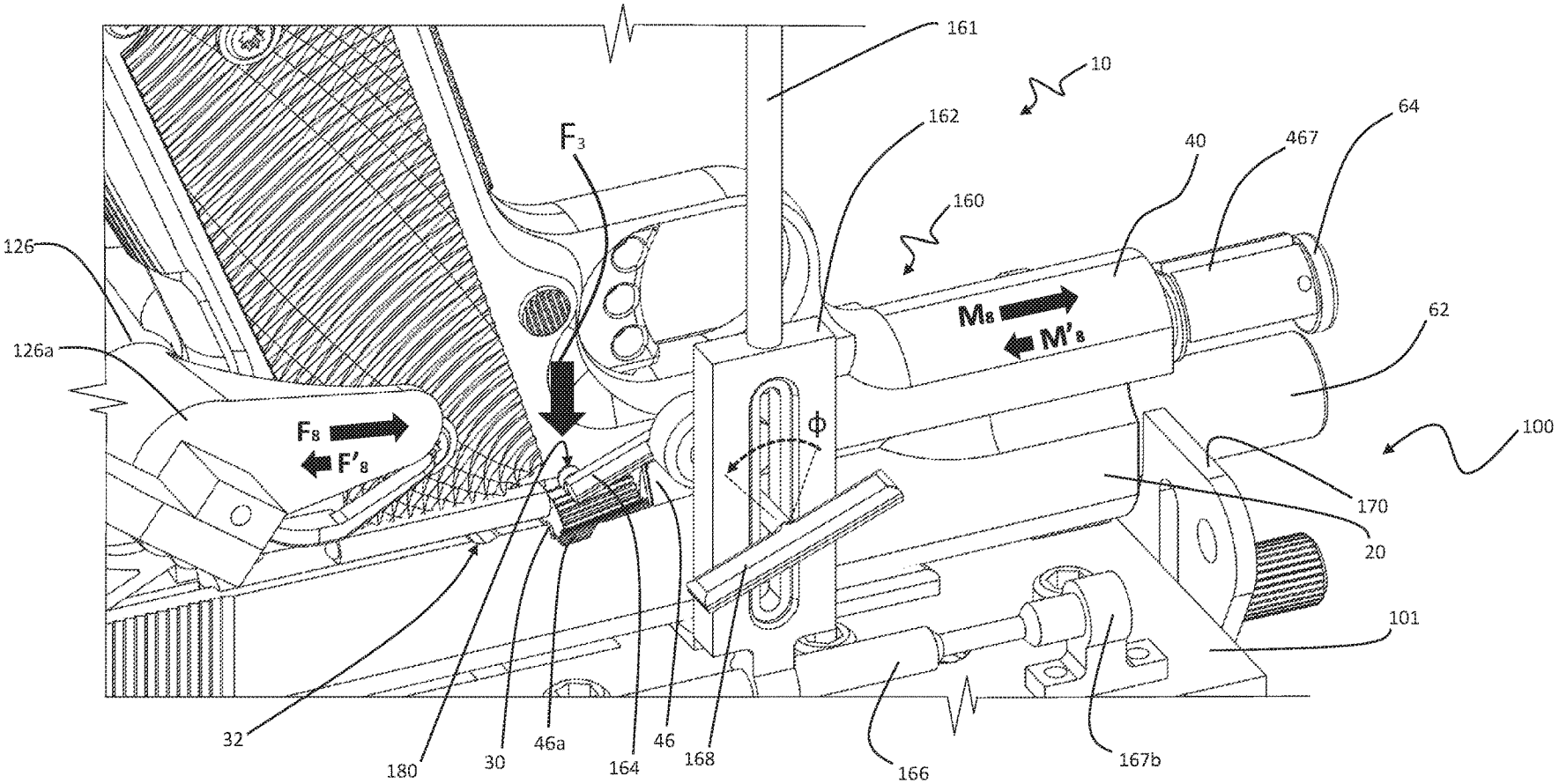

Because the slide lock 46 is attached to the frame 40, it also moves forward with the frame while the slide 20 remains stationary, and thus moves toward the slide catch 30. Once the frame 40 is pushed forward enough, the slide lock lever 46*a* can be rotated so as to engage the slide catch 30, which locks the slide 20 in position relative to the frame 40 such that it will not automatically snap back into position when outside forces are removed. The slide lock lever 46*a* can be rotated so as to engage the slide catch 30 manually. Alternatively, part of the device 100 can be used to rotate the slide catch 30, as best seen in FIG. 3C. For instance, in the embodiment shown, the slide lock rotator 164 of the slide lock operation device 160 can be rotated against the slide lock lever 46*a* so as to rotate the slide lock lever 46*a* downward and into the slide catch 30. Portions of the slide lock rotator 164 that physically contact the firearm 10 can be made of material designed to avoid scratching or otherwise defacing the firearm 10, and/or can have good gripping qualities. For instance, in one embodiment, the end of the slide lock rotator 164 can be rubber, such as an elastomeric hard rubber material. Additional uses of the slide lock rotator 164 will be described in more detail below with regard to FIG. 6.

In order to disassemble the firearm 10, the slide lock 46 should be removed from the frame 40. Prior to removing the slide lock 46, however, the recoil spring of the firearm 10 should be disabled. To do this, takedown piece 467 (which can be the same as or similar to the takedown piece 66) can be placed onto the spring rod 64 so as to maintain distance between the frame 40 and the end of the spring rod 64, even under pressure from the internal recoil spring.

Figure 4A:
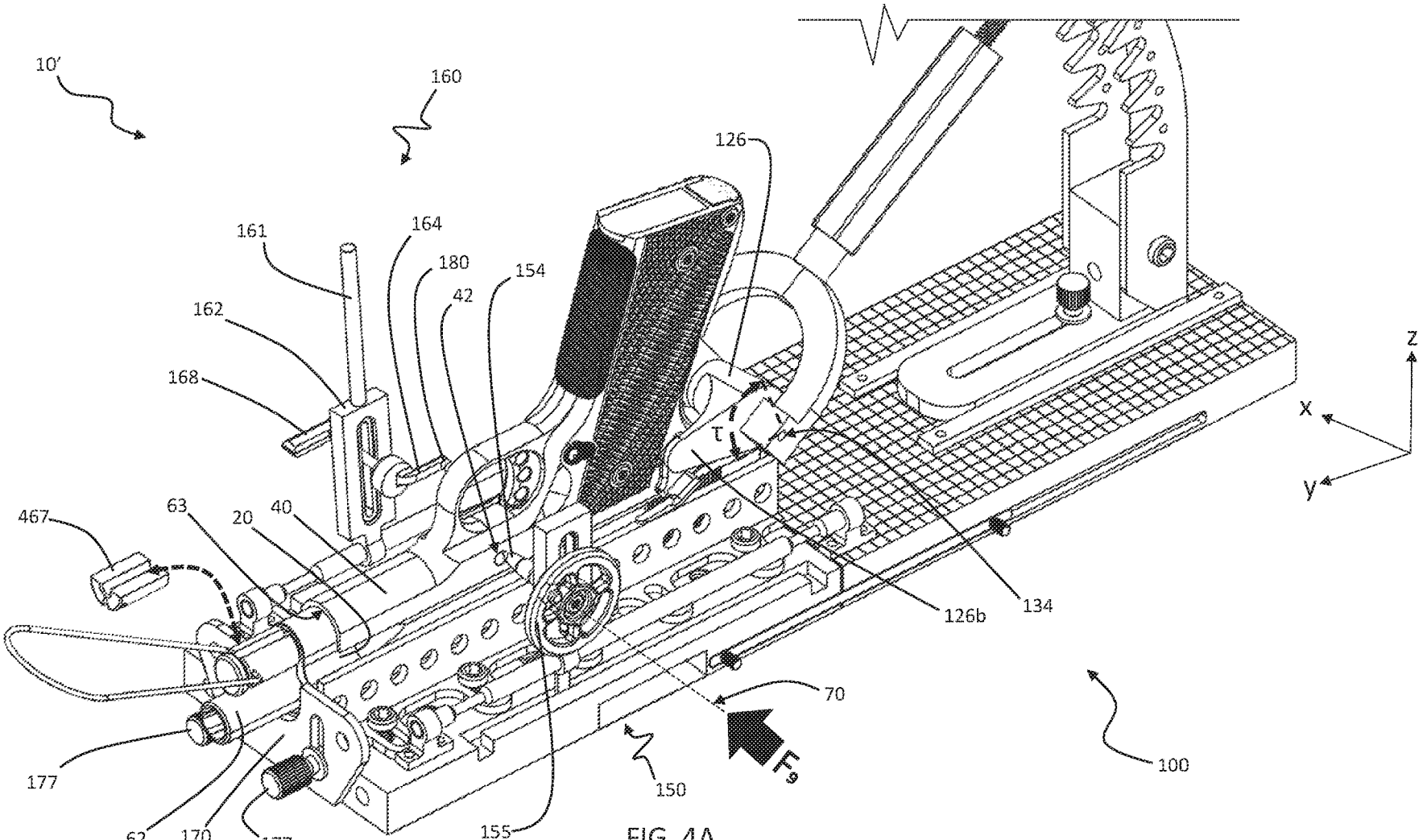
FIGS. 4A-4C are perspective views of the device from FIGS. 2A and 2B in combination with the firearm from FIGS. 1A-1G, with the firearm in different states of disassembly.
Figure 4B:
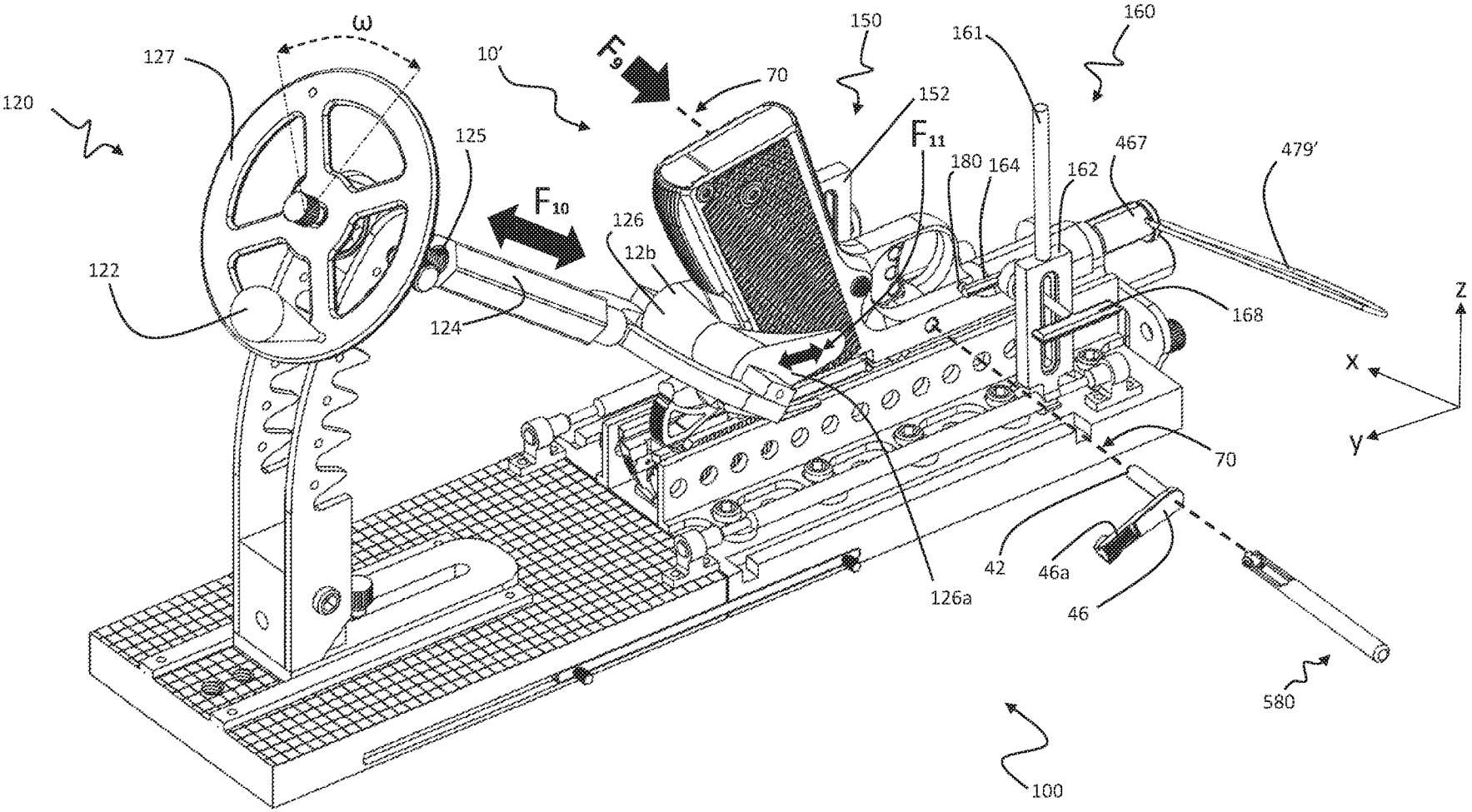
Figure 4C:
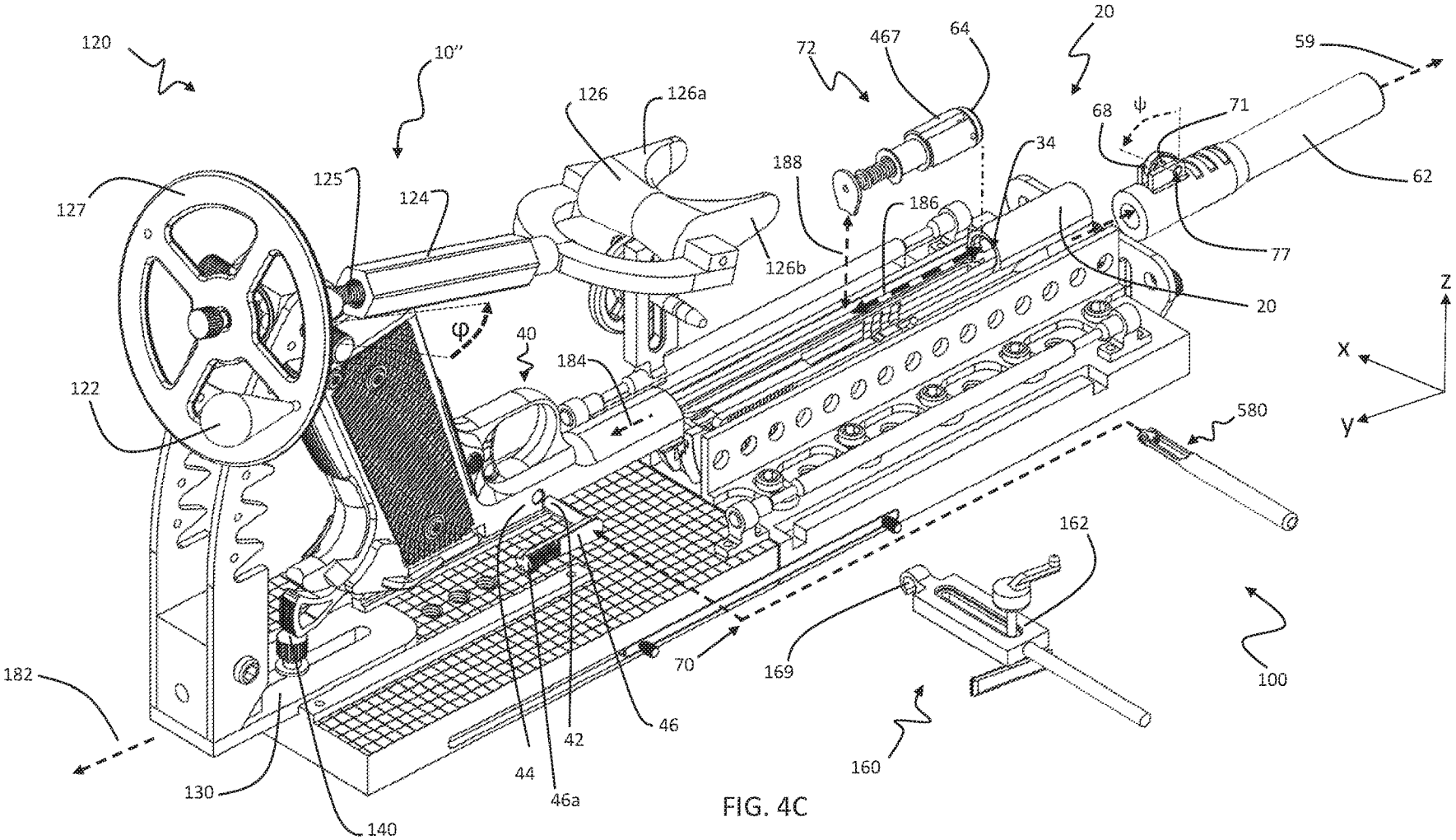
Figures 4D, 4E, 4F, 4G:
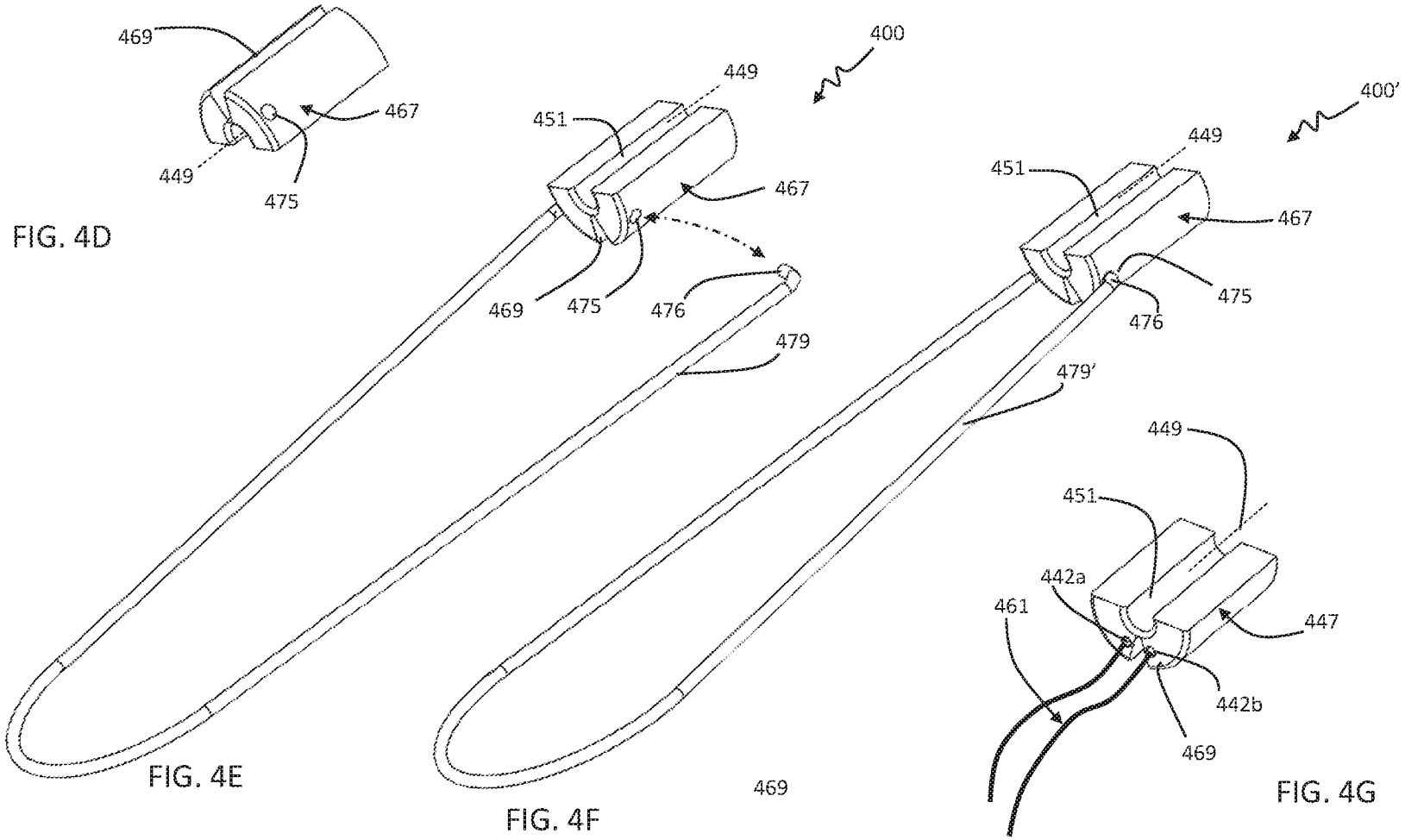
FIGS. 4D-4G are perspective views of takedown devices and/or takedown pieces according to some embodiments of the present disclosure.

FIGS. 4D-4G show takedown devices according to embodiments of the present disclosure, which can be used to attach a takedown piece to the spring rod 64 and/or remove the takedown piece from the spring rod 64. First, FIG. 4D shows a takedown piece 467 according to one embodiment of the present disclosure. The takedown piece 467 includes a groove 469, which can be a V-shaped groove. This can allow for the takedown piece 467 to flex such that it can be more easily applied to the spring rod 64. The takedown piece 467 also includes two tweezer apertures 475, which can be used in conjunction with a takedown device such as the takedown device 479 shown in FIGS. 4E and 4F. The takedown device 479 is tweezer-like, with ends 476 that can be closed to the position 479' shown by FIG. 4F, so as to be in the apertures 475. Further squeezing the takedown device 479 can result in further opening of the linear aperture 451 which is designed to surround the spring rod 64, thus making application of the takedown device 479 easier. As previously described, this flexibility is further enabled by the inclusion of the V-shaped groove 469. The takedown piece 467 can be made of a flexible but durable material, such as hard rubber of flexible plastic, though other materials such as metal are also possible.

FIG. 4G shows another embodiment of a takedown device and takedown piece. In this embodiment, the takedown piece 447 includes drawstring apertures 442*a*,442*b*, and drawstrings and/or wires 461, which can be attached to the takedown piece 447 via the apertures 442*a*,442*b* to assist in placement of the takedown piece 447 on the spring rod 64.

Once a takedown piece is safely in place, the slide lock 46 can be removed, as best shown in FIGS. 4A and 4B. First, the slide lock lever 46*a* can be disengaged from the slide catch 30, either manually or using a device such as the slide lock rotator 164. Next, the crank 122 can be operated in the opposite rotational direction from that described above. This will reduce and/or remove the forward pressure from the push mechanism 126 on the frame 40, such that the frame 40 and other portions of the firearm 10 are backed away from their previous position. This can be done until the frame 40 is partially backed out to an intermediate position of the firearm 10", shown in FIG. 3C, where the slide lock 46 can be removed from the frame 40. This position can be indicated by the slide lock release position notch 32; when the end of the slide lock lever 46*a* is even with the slide lock release position notch 32. The firearm 10 is arranged such that the slide lock 46 is able to be removed.

As previously discussed, the slide lock 46 includes the slide lock pin 42 which is within the slide lock through-hole 44 in the frame 40. Once in the position shown in FIGS. 4A and 4B, a user can manually push the slide lock pin 42 from the side of the firearm 10 opposite the slide lock lever 46*a* using a force F9, such that the slide lock pin 42 slides out of the slide lock through-hole 44, and the slide lock 46 is removed. Alternatively, the user can use the plunger device 150 to apply the force F9. The plunger 154 can be moved substantially perpendicular to the orientation of the firearm 10 so as to push the slide lock pin 42 out of the slide lock through-hole 44, or in another manner, so as to push the slide lock pin 42 out of the slide lock through-hole 44. During this removal process, it can be helpful to "wiggle" the firearm 10 in order to aid the slide lock pin 42 in reaching the correct position. This type of movement can be achieved using the crank device 120 to apply a back and forth force F10, which in turn applies the back and forth force F11.

After the slide lock pin 42 is removed, the firearm can be removed from the device 100, such as by further backing out the push mechanism 126 and manually removing the firearm 10. The firearm 10 can then be further disassembled manually as is known in the art, such as is shown in FIG. 4C.

Firearm Reassembly

After the firearm 10 is cleaned, parts replaced, etc., the firearm 10 can be reassembled as is known in the art to the configuration just after the slide lock pin 42 was removed. The firearm 10 can again be placed in an inverted position on the device 100, and moved to the position of the firearm 10". Just as the slide lock 46 was removable from this position, it is also able to be replaced when in this position. This position can be found using the slide lock notch 32 as previously described.

Figures 5A, 5B:
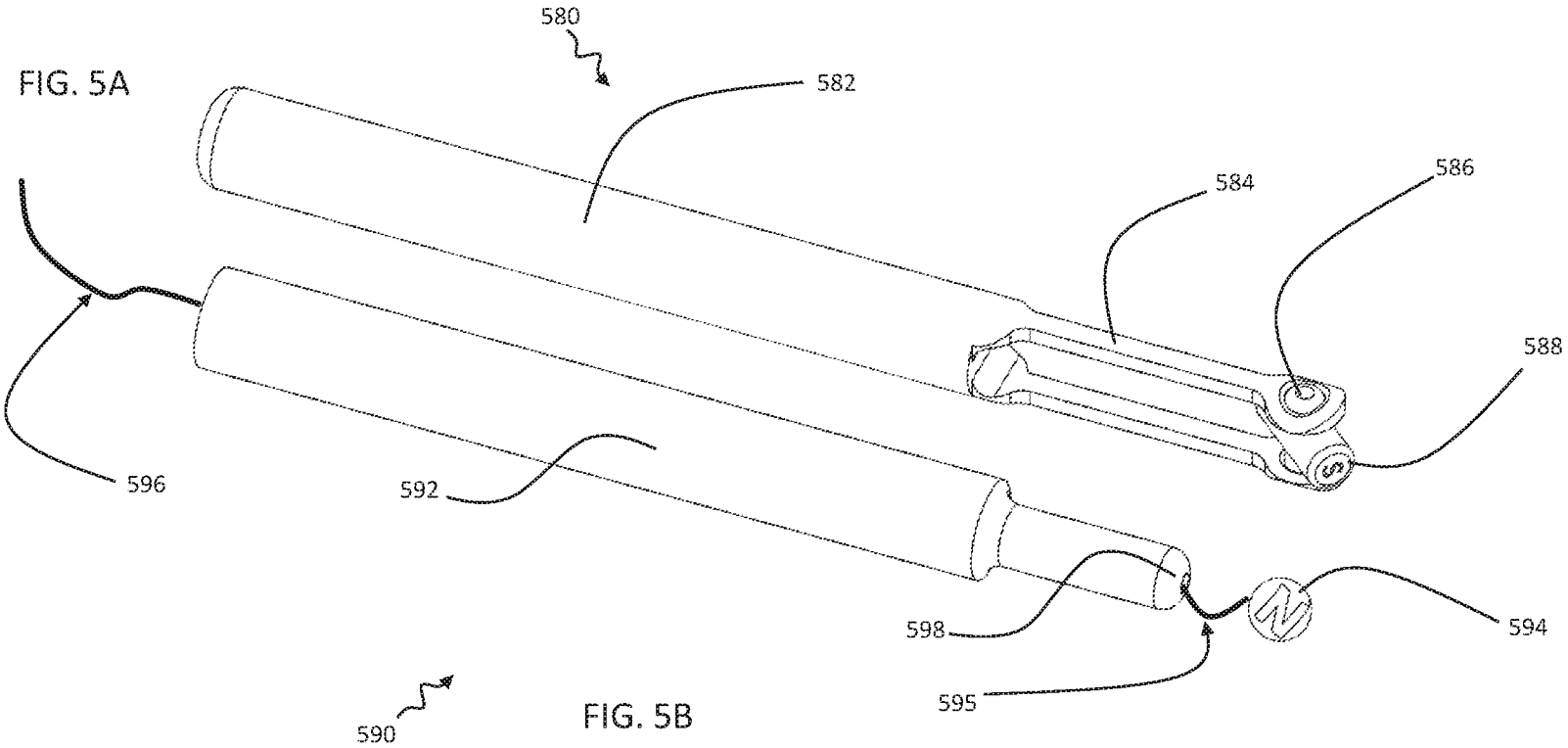
FIGS. 5A and 5B are perspective views of barrel link erection tools according to some embodiments of the present disclosure.
Figure 5C:
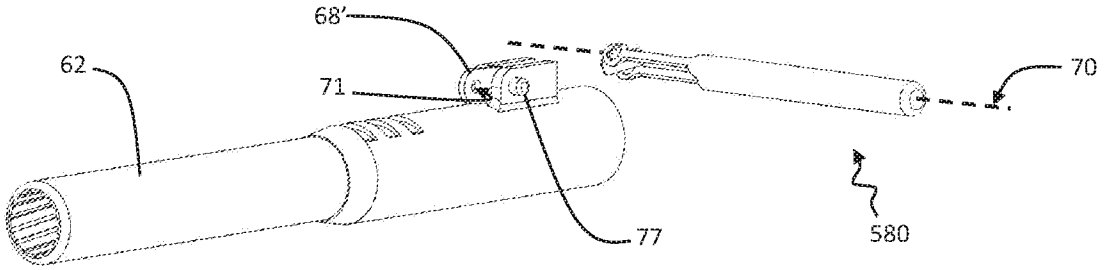
FIGS. 5C-5E are operational perspective views of a barrel link erection tool according to one embodiment of the present disclosure.
Figure 5D:
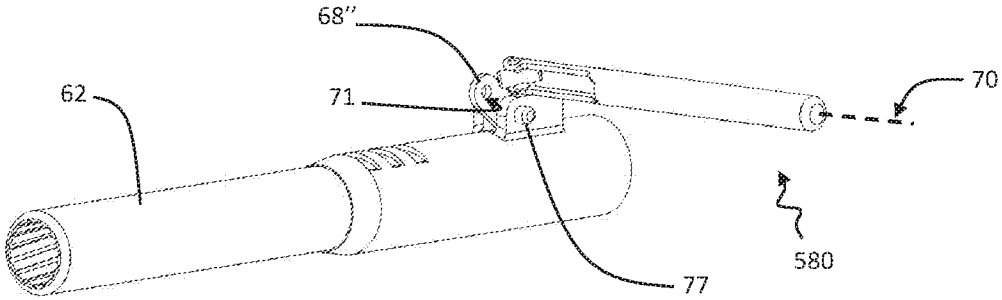
Figure 5E:
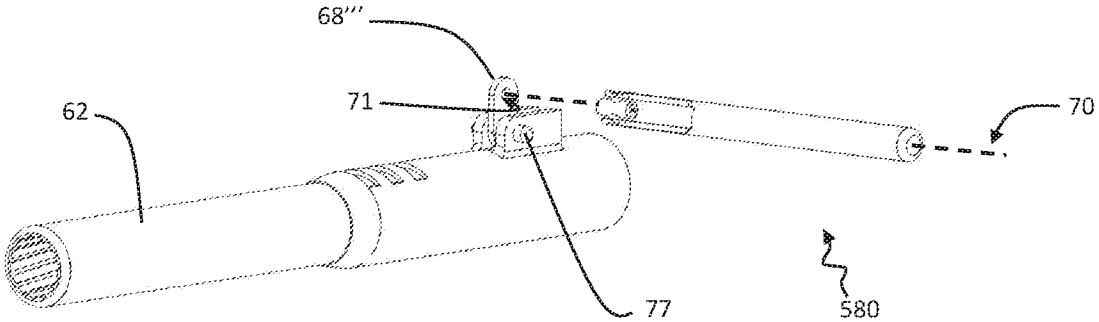

Additionally, the barrel link 68 must be put into an upright position, as shown in FIG. 5E, so as to align with the slide lock through-hole 44. Once these positions are achieved, the slide lock pin 42 can manually be placed through slide lock through-hole 44 in the frame 40 and through the barrel link 68, and the slide lock lever 46*a* into another aperture in the frame 40 in which it rests, and from which it can be rotated to engage the slide catch 30 as desired. Fitting the slide lock 46 into these two apertures can be difficult, and it can be helpful to operate the crank 122 forward and backward while pushing the slide lock 46 inward toward the frame until the exact correct position is found and the slide lock 46 fully engages the frame 40. Once the slide lock 46 has been fully replaced, the takedown piece can be removed. The crank 122 can then be operated to move the frame either forward to a position where the slide lock lever 46*a* can engage the slide catch 30, or backward to the starting position of the firearm 10. The firearm 10 can then be removed from the device 100.

Alternatively, the slide lock 46 may be replaced in another manner. Placing the barrel link 68 into an upright position can be very difficult and require multiple attempts. FIG. 5A shows two embodiments of barrel link erection tools 580, 590 according to the present disclosure. The first barrel link erection tool 580 includes handle 582 and fork tines 584 which are joined at the end by an axle 586 that goes through a magnet 588. The magnet 588 can be cylindrical in some embodiments so as to match the shape of the slide lock through-hole.

FIG. 5B, for simplicity of viewing, shows some portions of the firearm 10 with many other portions not shown. The shown elements include the barrel 62, barrel link 68 with barrel link through-hole 71, and barrel link pivot pin 77. As the barrel link erection tool 580 is placed nearer to the barrel link 68, the barrel link moves from the downward position 68', to an intermediate position 68", and finally to the upright position 68'" where it is aligned with the slide lock through-hole 44, after which the barrel link erection tool 580 is removed. The slide lock pin 42 can then be placed through the slide lock through-hole 44 and barrel link through-hole 71.

Also shown in FIG. 5A is a second barrel link erection tool 590. The tool 590 can include a handle 592 with a drawstring 596 through a through-hole 598, and attached to a magnet 594 at the forward end of the handle 592. The barrel link erection tool 590 can be used as described above with regard to the barrel link erection tool 580.

Figure 6:
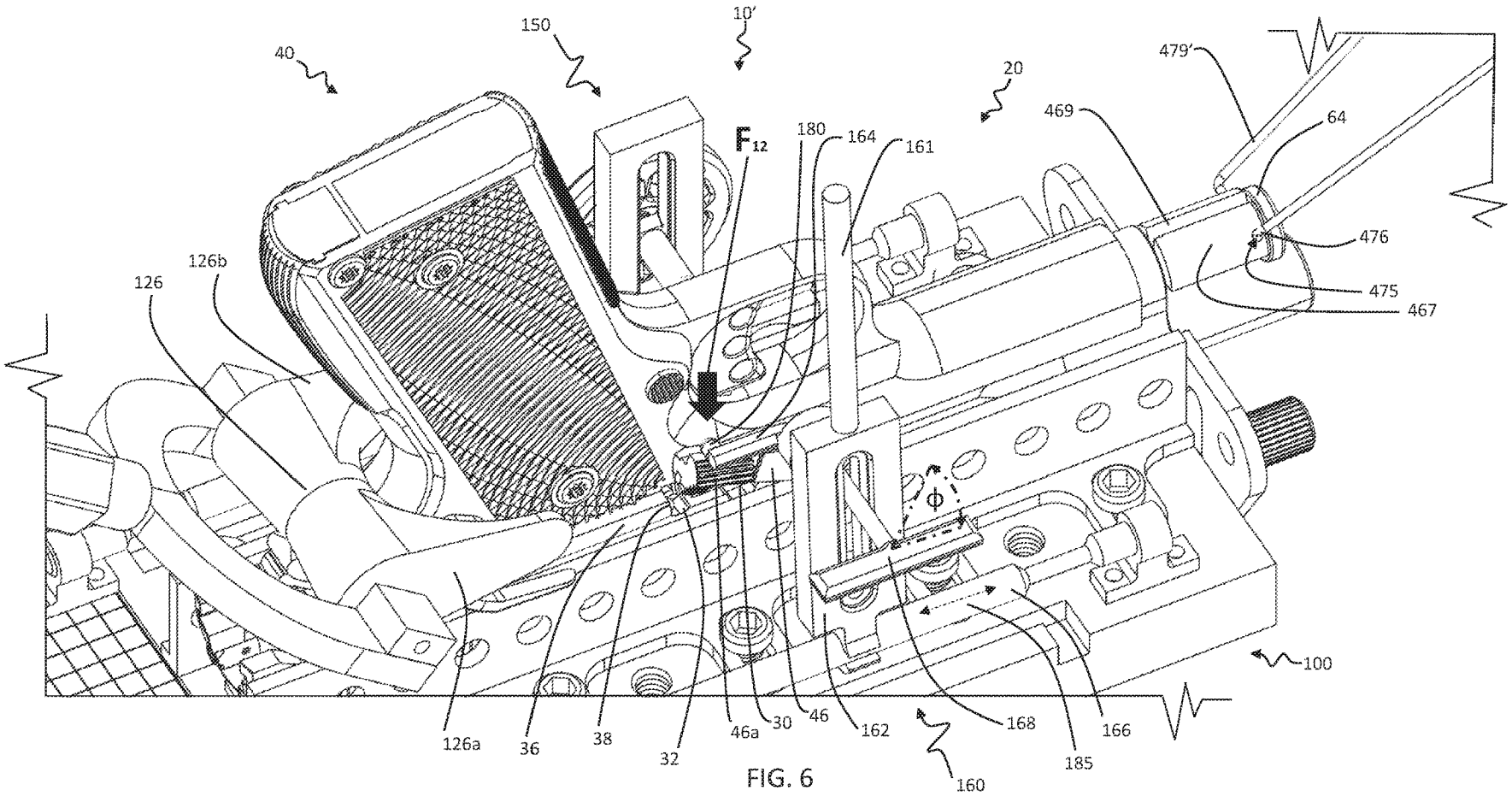
FIG. 6 is a perspective view of the device from FIGS. 2A and 2B in combination with the firearm from FIGS. 1A-1G, with the device being used to reassemble the firearm.

Replacement of the slide lock 46 can also be aided using components of the device 100. As part of reassembly and as shown in FIG. 6, the slide lock lever 46*a* should be placed into the slide stop disassembly notch 32, which includes a ball lock 38 at the end of the plunger tube 36 to hold it in place. After the slide lock pin 42 has been properly replaced, the slide lock operation device 160 can be used to replace the slide lock lever 46*a*. The T-handle 168 or other similar device can be rotated to arm 164 and knob 180 to rotate downwards until the arm 164 and/or knob 180 (which can be made of the materials described above to avoid scratching or other damage) encounters the slide lock lever 46*a*. A user can continue the rotation such that the lever 46*a* is pushed downward, until it locks into place in the notch 32. A handle 161 extending from the stand 162 can aid in the process by providing a user with leverage and/or helping the user keep the stand 162 in an upright position.

Firearm Chamber Clearing

The device 100 can also be used to clear the chamber of the firearm 10 by "racking" the slide 20. The firearm 10 can be placed in the device 100 as described above at the beginning of the disassembly method. The crank assembly 120 can then be used to push the frame 40 to a fully forward position with regard to the slide 20 such that any round in the chamber falls out. Optionally, the crank assembly 120 can then be used to fully retract the frame 40 and then again fully push the frame 40 to a fully forward position, for maximum safety. The crank assembly 120 can then be operated to retract the frame 40 to its original position, or to a position where the slide lock lever 46*a* can engage the slide catch 30, and the firearm 10 can then be removed from the device 100.

Cam Lever Assembly

Another device that can be used in disassembly/reassembly methods according to the present disclosure is the cam lever assembly 200 shown in FIGS. 7A-7D. Some models of firearms, such as that shown in FIGS. 7A-7D, include a barrel bushing 244. In a prior art method of removing a spring assembly, a user must rotate the barrel bushing 244 while maintaining pressure on the spring so it does not pop out, which could cause injury. This process is unwieldy and can be dangerous. Instead of going through this prior art procedure, the cam lever assembly 200 can be used.

The cam lever assembly 200 can include a cam base 202, cam frame 204, pivot points 210, first and second cam lever arms 206*a*,206*b* (one of which 206*a* can be larger than the other 206*b* to produce a mechanical advantage), a cam bushing sleeve 216, a cam piston 214 (in this embodiment including portions 214*a*,214*b* before and after the cam bushing sleeve 216, cam track 218 with accompanying cam pin 220, cam shaft 219, and cam push tab 222. Connectors 230,228, which may be removable, can connect the cam frame 204 to the cam base 202 and the cam base 202 to the base 102. The cam base 202 can include cam base anchor tabs 226 through which the connectors 228 can pass.

Figure 7A:
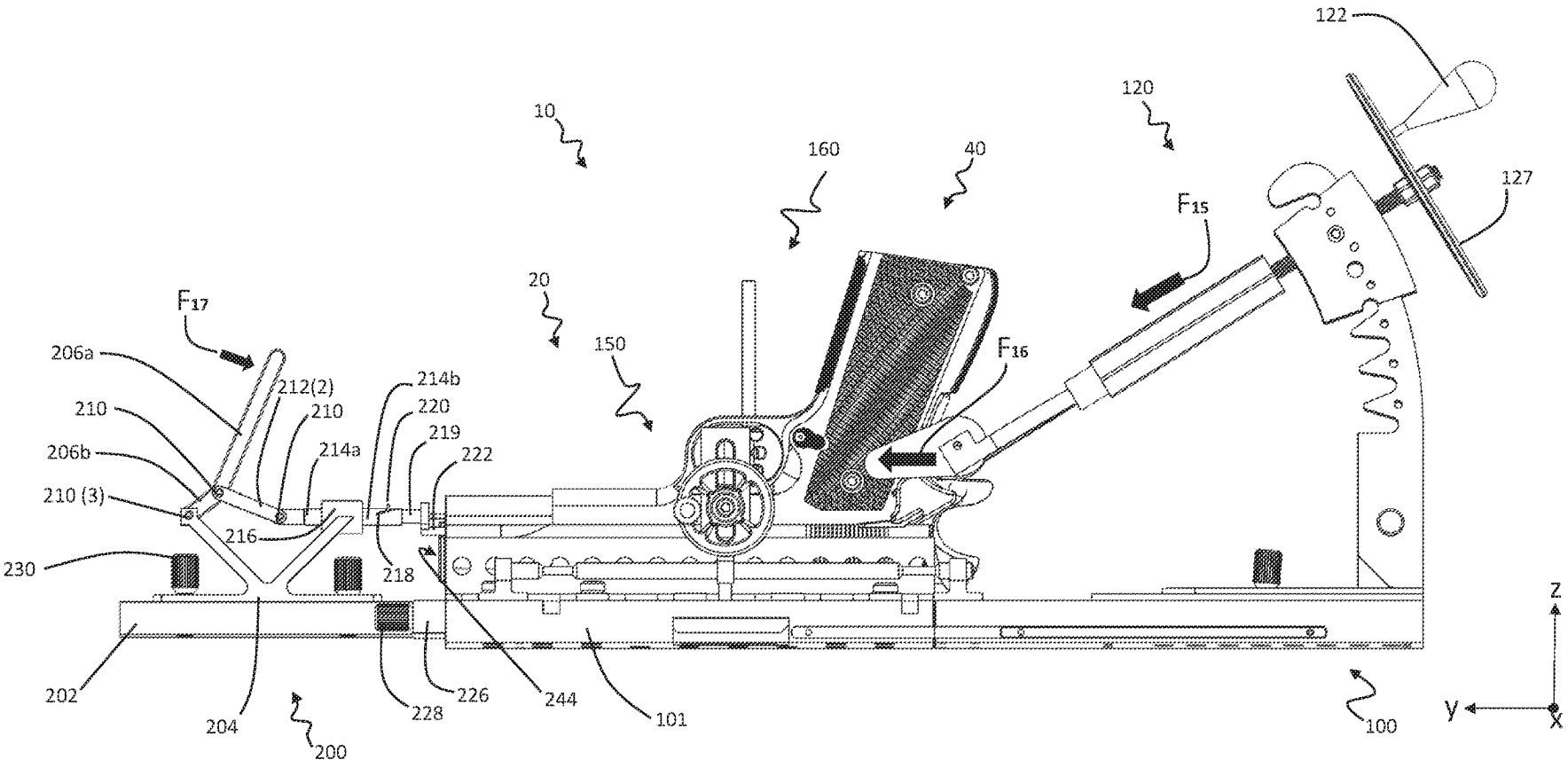
FIGS. 7A-7D are a side view and three perspective views of the device from FIGS. 2A and 2B in combination with a prior art firearm, and further in combination with a cam lever assembly according to one embodiment of the present disclosure.
Figure 7B:
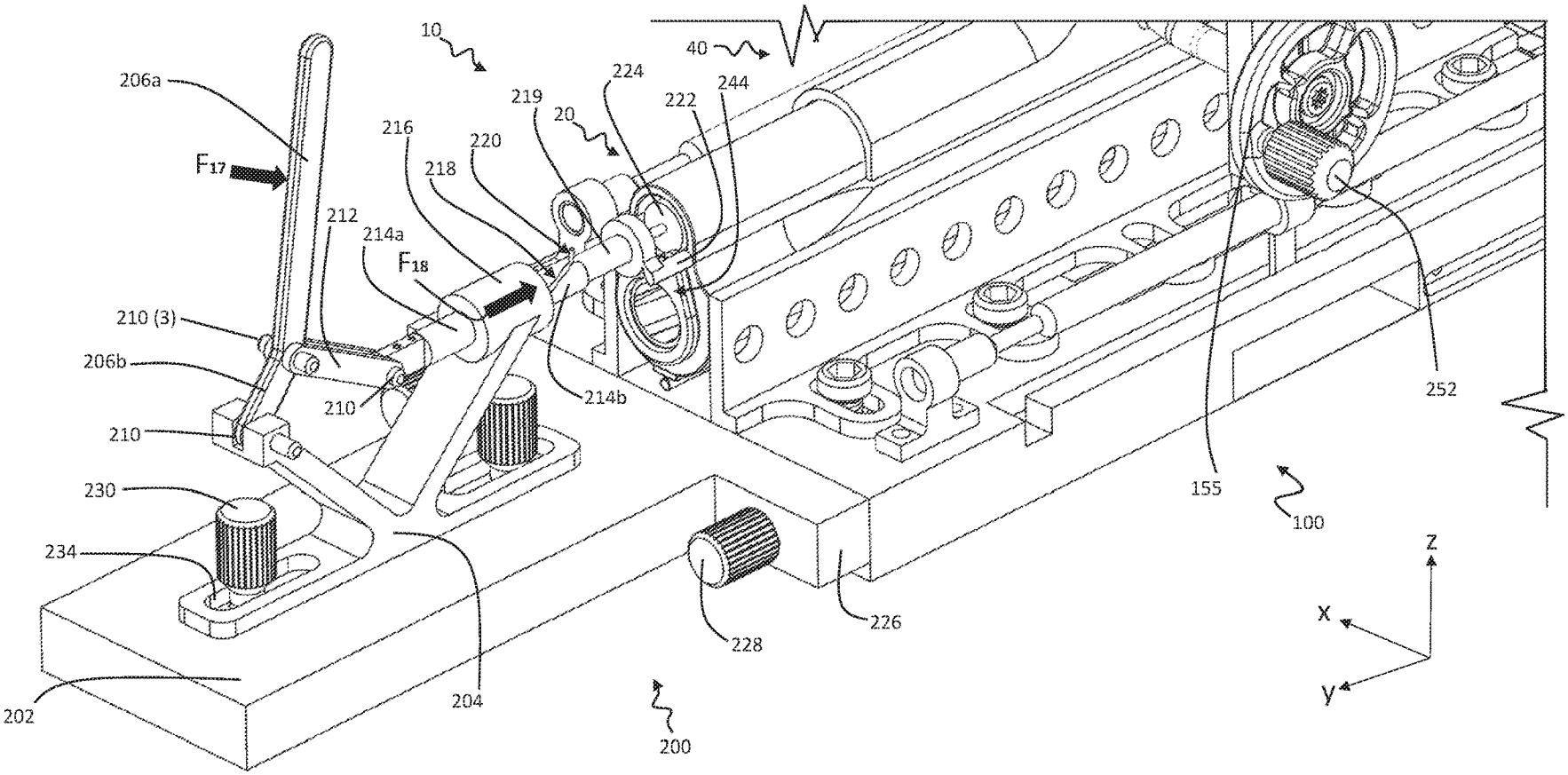
Figure 7C:
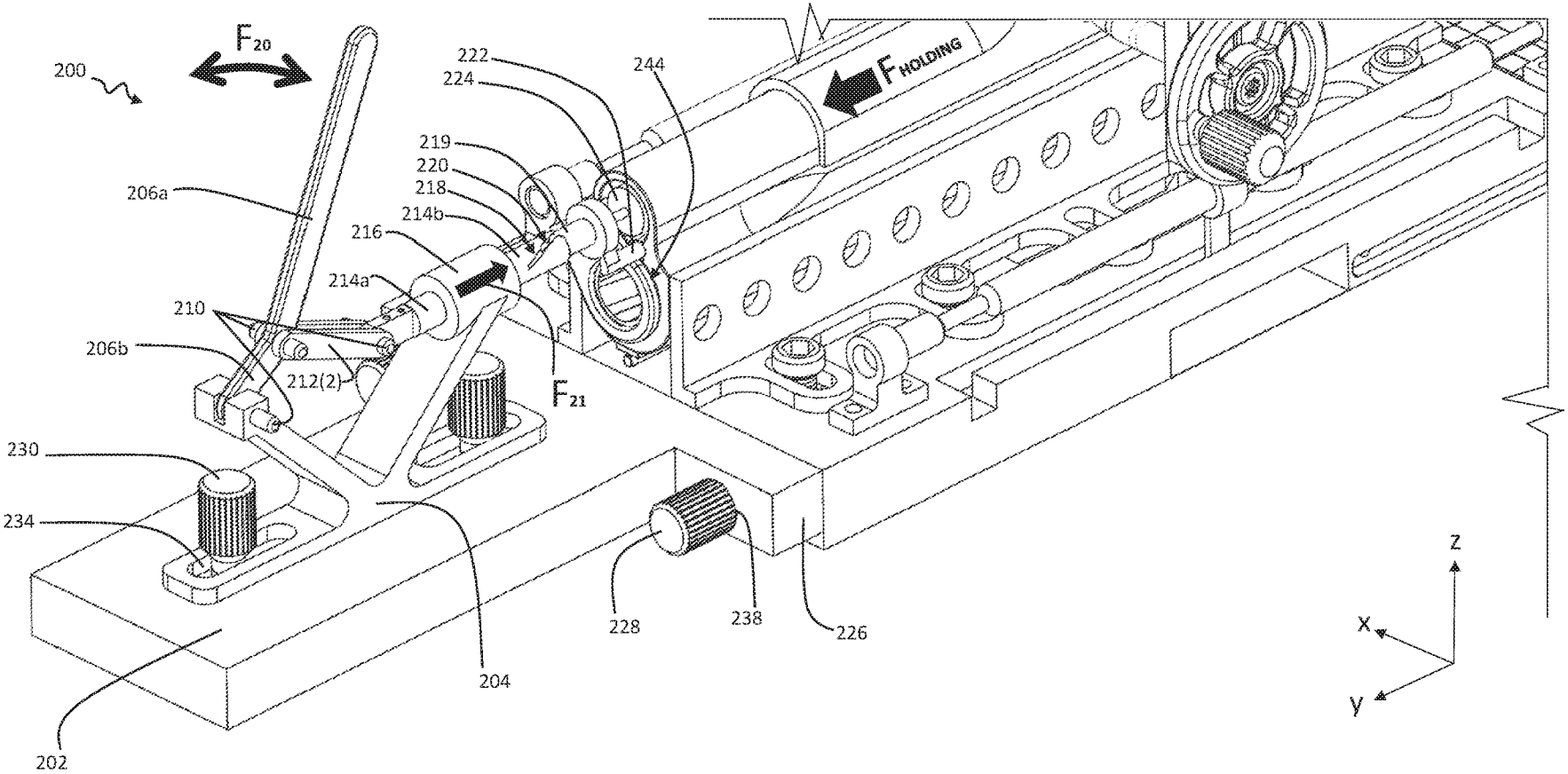
Figure 7D:
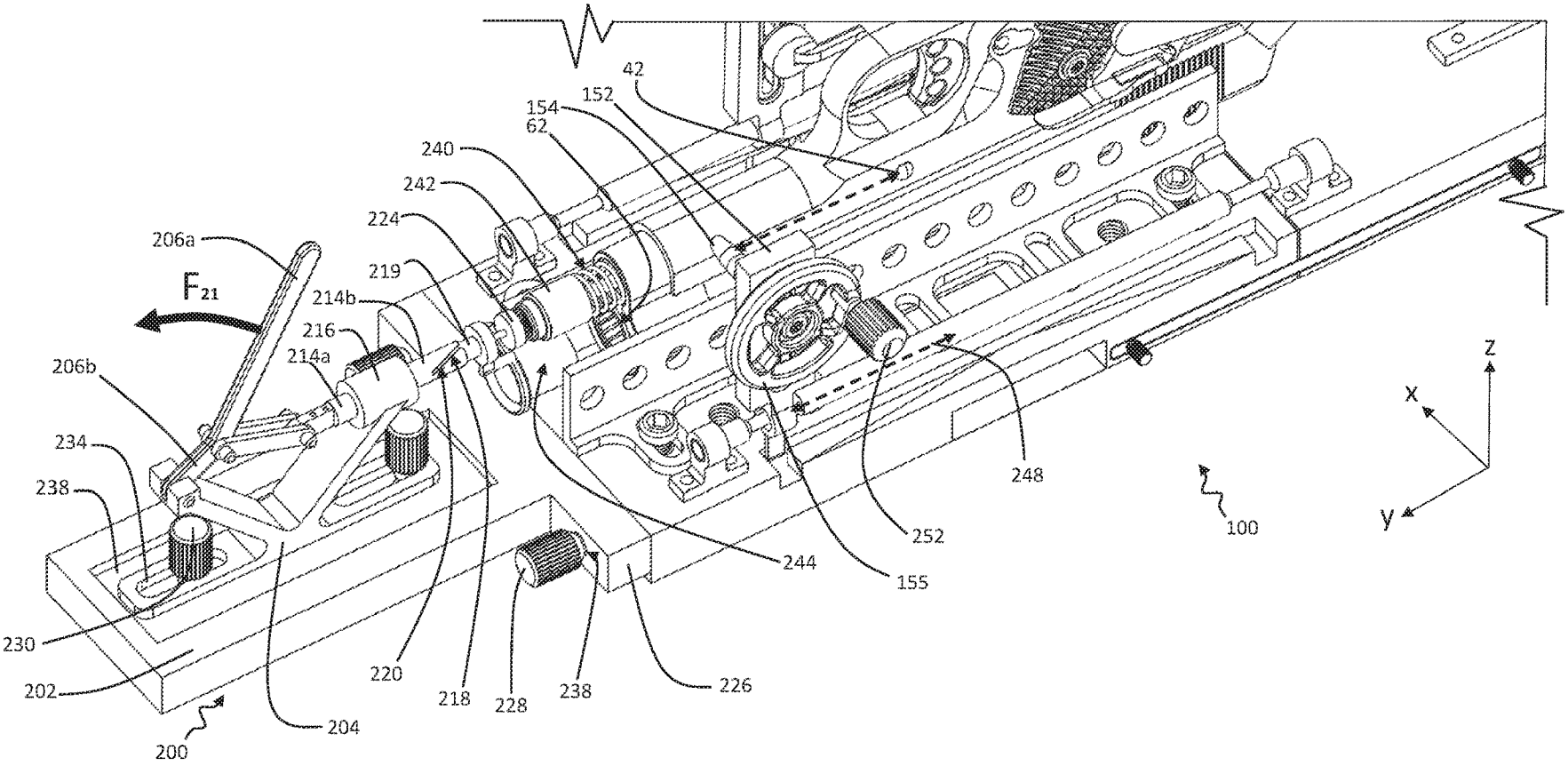

As lever arm 206*a* is pushed forward as indicated in FIG. 7B, the cam track 218 and cam pin 220 translate this motion into rotational motion of the cam push tab 222, while pushing the cam spring plunger 224 forward. The cam push tab 222 thus pushes the barrel bushing 244 out of its locked position where it retains the spring, while the cam spring plunger 224 maintains the internal spring in its position, as shown best in FIG. 7C. Then as best shown in FIG. 7D, the lever arm 206*a* can be operated backward to slowly release the spring 240 in a safe manner. The firearm can then be further broken down as known in the art.

Alternative Embodiments

While the above-described figures show some embodiments of firearm disassembly and/or reassembly devices according to the present disclosure, many different embodiments are possible. For instance, while the device 100 includes a downwardly angled crank shaft 125, FIG. 8A shows a device 300 including a crank mechanism 320 with a substantially horizontal crank shaft 324. The device 300 and/or crank mechanism 320 can include other elements that are similar to and/or substantially same as the device 100, such as the push mechanism 126. Additionally, while a hand crank 322 comprising a wheel is shown, other embodiments are possible, such as a motor crank. It is understood that while FIG. 8A does not show the portion of the device 100 including guiderails and other elements, such elements can be included.

Figure 8B:
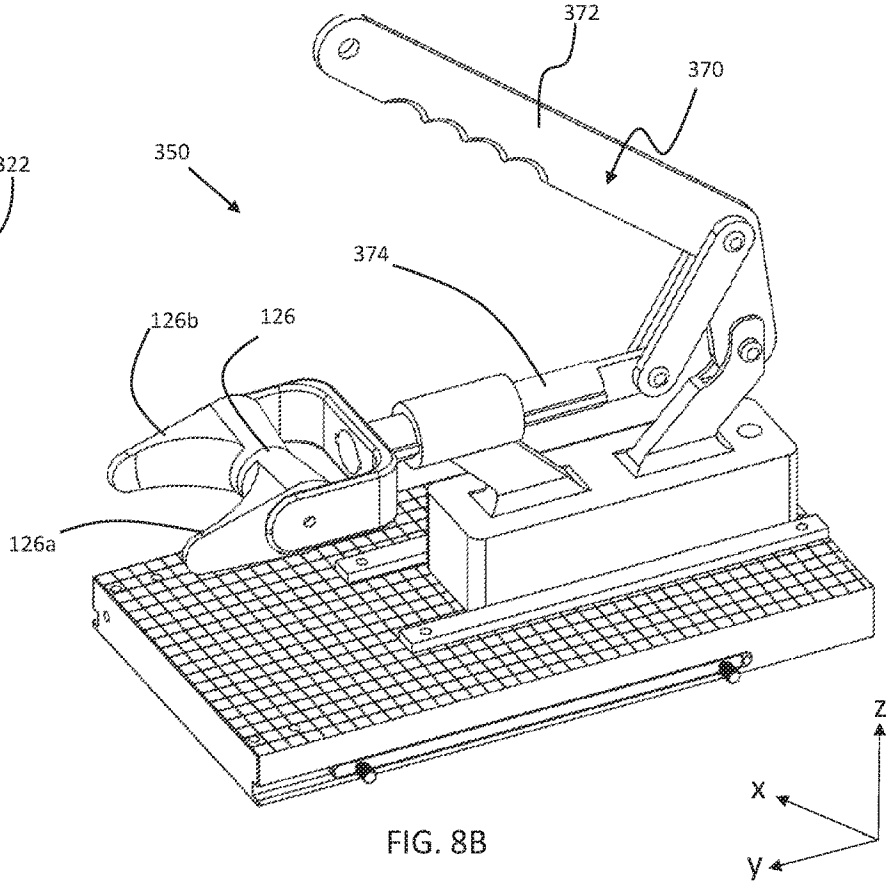
FIGS. 8A and 8B are perspective views of parts of firearm disassembly and/or reassembly devices according to other embodiments of the present disclosure.
Figure 8A:
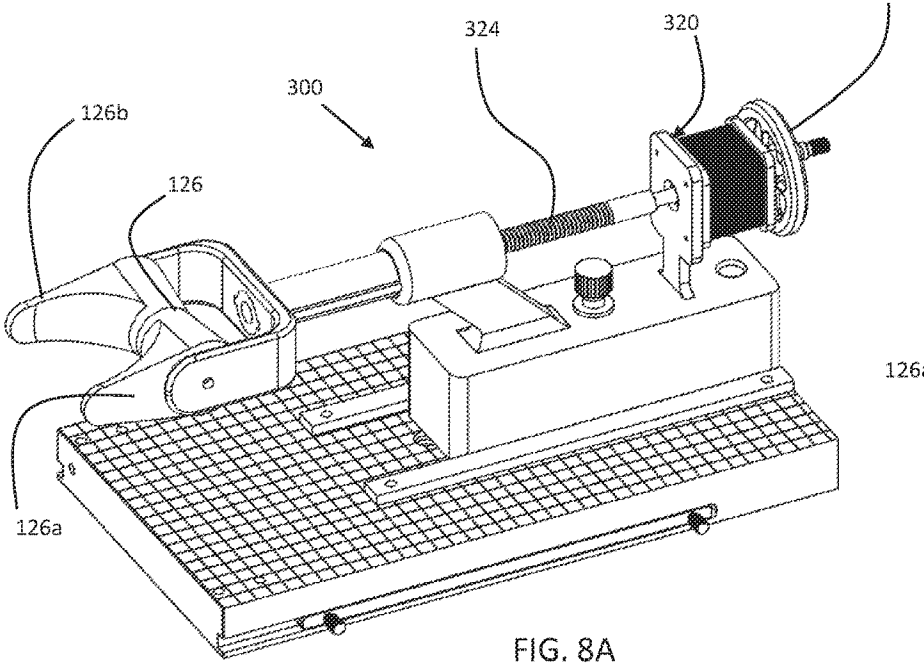

FIG. 8B shows another variant of a device according to the present disclosure. The device 350 includes a lever mechanism 370 which can be used in place of a crank mechanism such as the crank mechanism 120 and/or 320. The lever mechanism 320 can include a lever handle 372 operable to push a lever shaft 374 and/or push mechanism 126 forward. In the specific embodiment and view shown, as the lever handle is pulled upward/backward, the lever shaft 374 and push mechanism 126 are pushed forward. While the lever shaft 374 in the specific embodiment shown is substantially horizontal, it is understood that other embodiments, such as an embodiment where the lever shaft is angled downwardly, are possible. It is understood that while FIG. 8B does not show the portion of the device 100 including guiderails and other elements, such elements can be included.

Figure 9A:
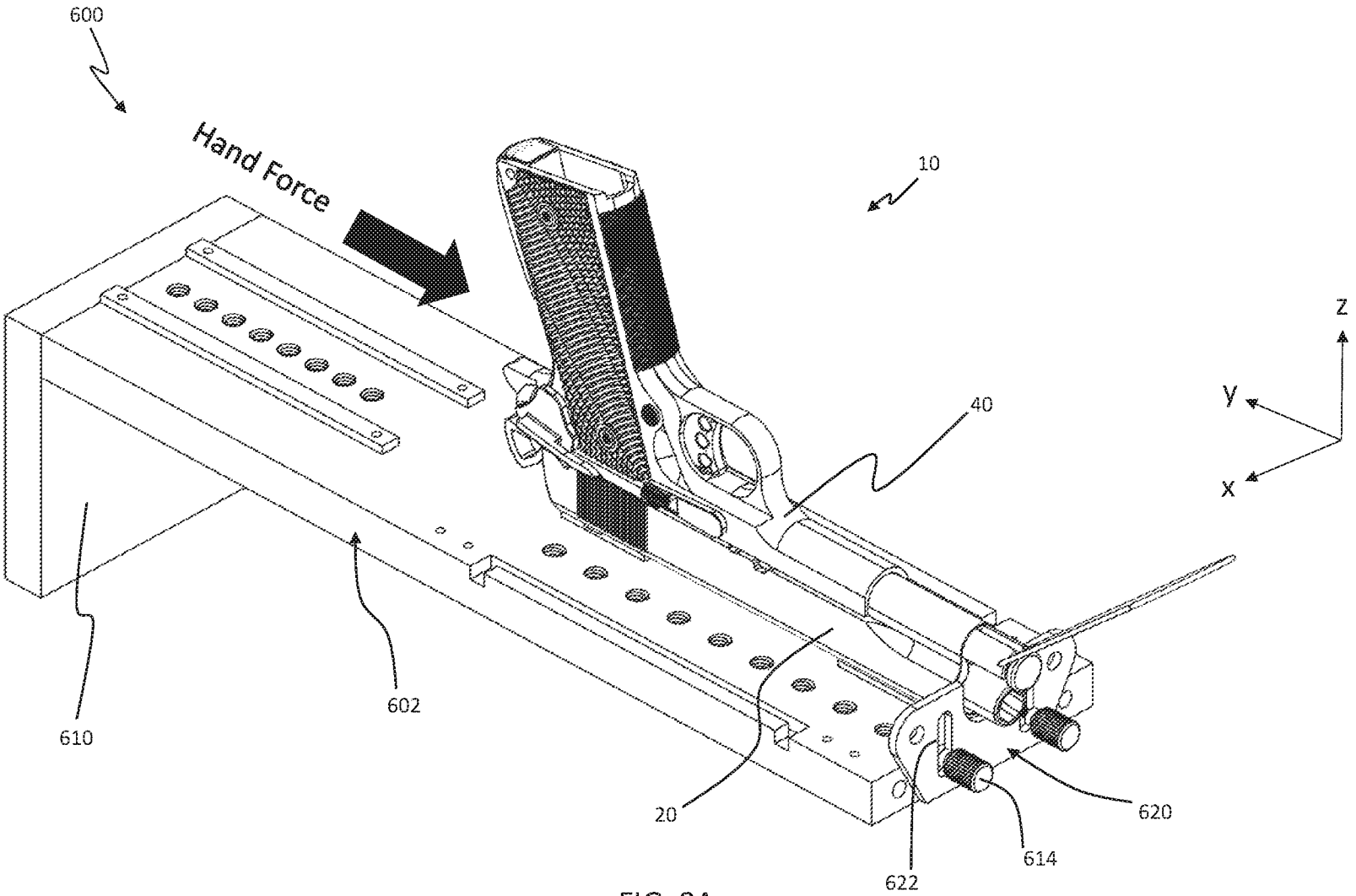
FIGS. 9A and 9B are perspective views of firearm disassembly and/or reassembly devices according to yet other embodiments of the present disclosure.

As another variant of a device according to the present disclosure, it is understood that human power could be used to push the frame 40 of the firearm 10 forward instead of a crank or lever mechanism. For instance, in one embodiment, the crank mechanism 120, crank base guides 132, connector 140, and other elements may be omitted, and a user may simply push the frame 40 forward and/or allow the frame 40 to retract rearward. FIG. 9A shows another variant of a device 600 according to the present disclosure, the device 600 not including any crank, lever, or similar mechanism for pushing the frame 40 forward. The device 600 includes a base 602 and stop plate 620 which can be the same as or similar to the stop plate 170 from the device 100, and which can be attached to the base 602 using one or more connectors 614. Additionally, the stop plate 620 can include apertures 622 through which the connectors can pass, and which can allow for the stop plate 620 to be placed in different positions. A user can align the firearm 10 with the stop plate 620 and push the frame 40 of the firearm 10 forward as shown. The same general procedures described above with regard to the device 100 can then be performed while the user (or a device) maintains the frame 40 in a forward position. In another similar embodiment, guiderails such as the guiderails 104,105 can also be utilized, which can aid with stability when pushing the frame 40 forward.

In addition to the base 602, the device 600 can also include a catch 610. Catches such as the catch 610 can also be utilized in other embodiments of the present disclosure previously described and/or described below, particularly embodiments utilizing a base. The catch 610 can help to stabilize the base 602. For instance, the device 600 can be placed such that the underside of the base 602 is on a table, and then pushed forward until the catch 610 abuts the table. A user can then apply pressure to the frame 40 of the firearm 10, that pressure eventually making its way to the stop plate 620; but the catch 610 can counter this pressure to prevent the device 600 from sliding forward. In another usage, the catch 610 can be used as a hand grip, with a user holding onto the catch 610 to stabilize the device 600.

Figure 9B:
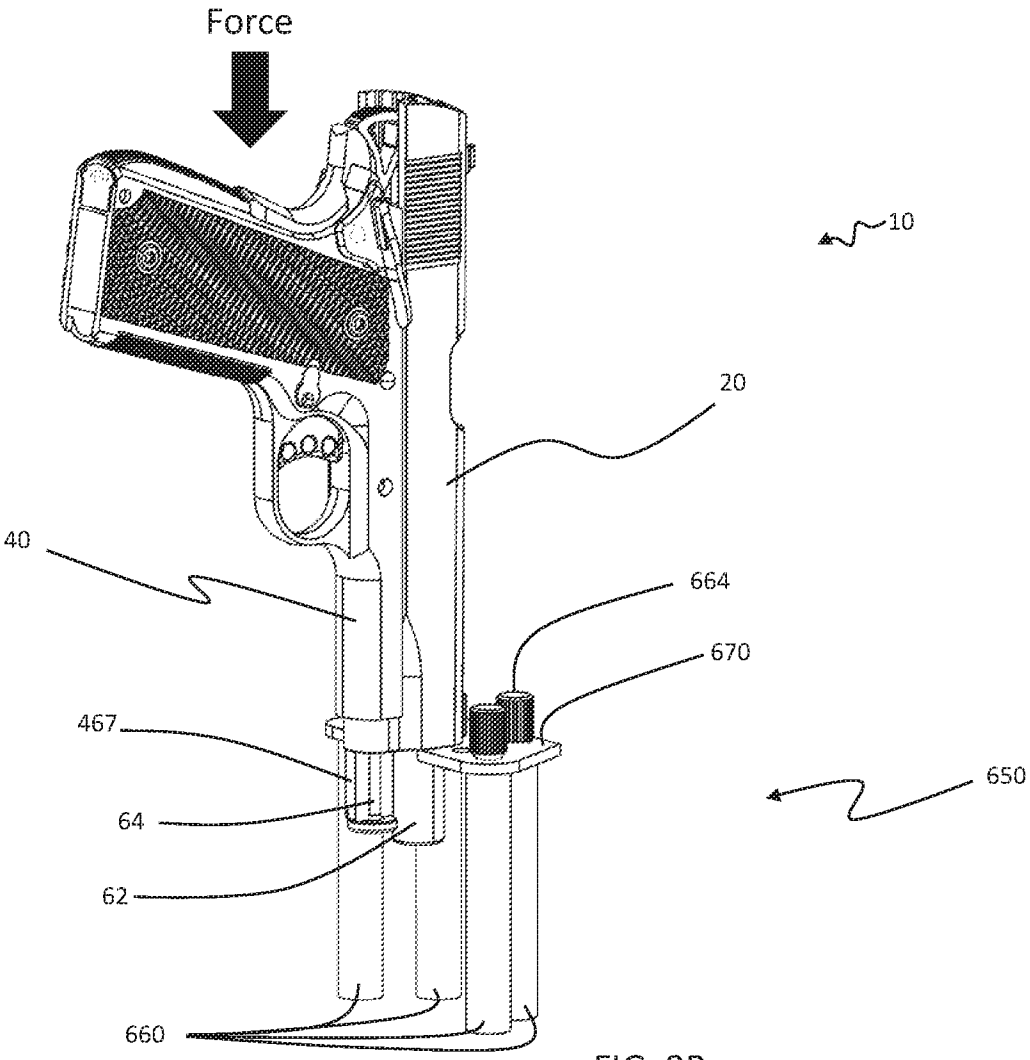

Yet another variant of a device according to the present disclosure is shown in FIG. 9B. The device 650 includes a stop plate 670 which can be the same as or similar to the stop plate 170 from FIG. 1. The device 650 can also include a base which, in this instance, includes one or more supports 660, with the embodiment shown including four supports 660. In this embodiment the supports 660 are pillars. The supports 660 as shown can be removable and have an adjustable position using a connector/aperture system such as one utilizing the connectors 664; however, it is understood that one or more permanent supports could also be used. The support(s) can be placed on a surface such that the stop plate 670 faces upward, and the user can place the firearm 10 against the stop plate 670 and press downward such that the slide 20 of the firearm 10 is maintained in place by the stop plate 670 while the frame 60 and other elements are pushed forward.

Folding Capability

Figure 10A:
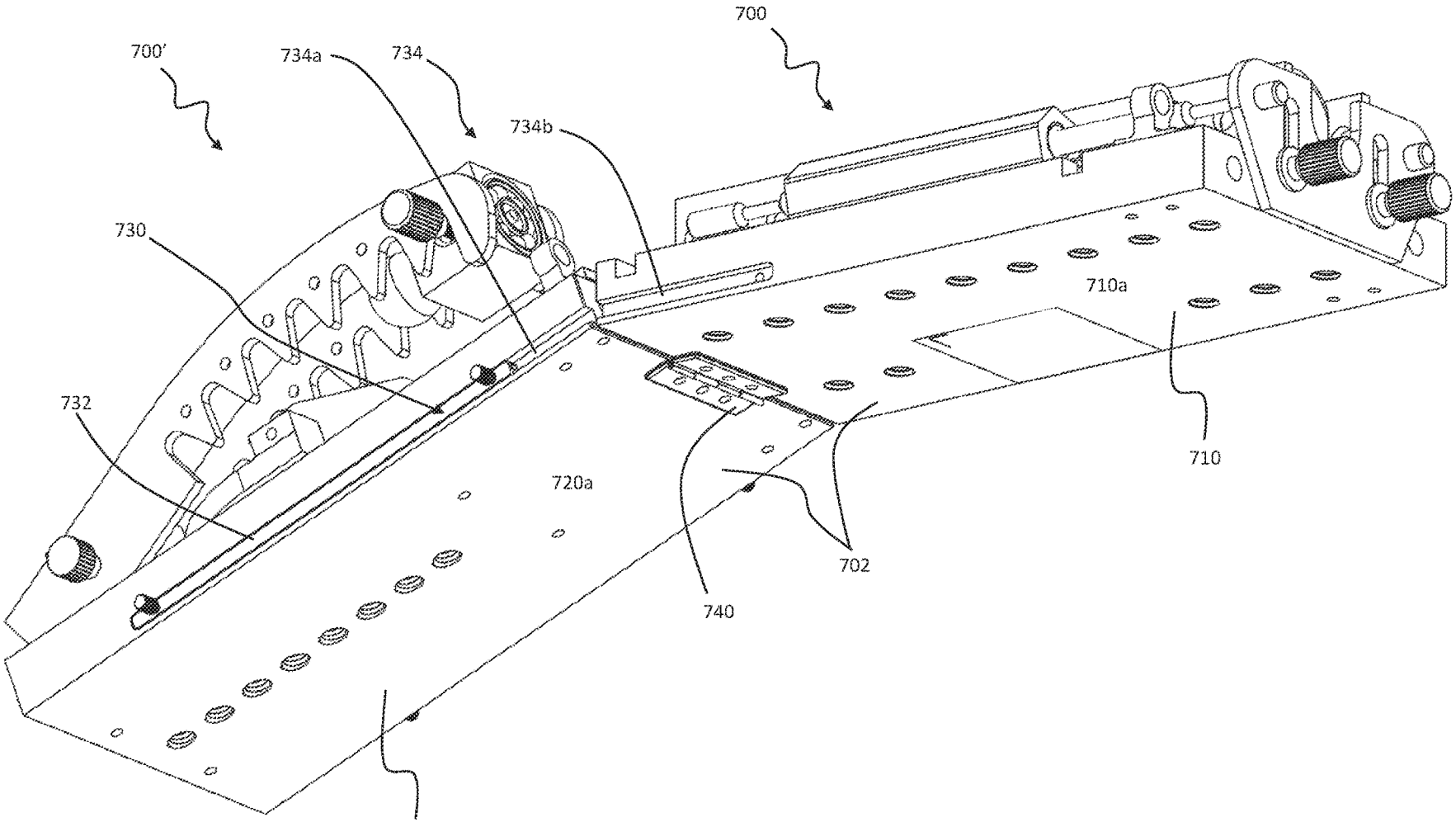
FIGS. 10A-10C are perspective views of a firearm disassembly and/or reassembly device according to yet another embodiment of the present disclosure.
Figure 10B:
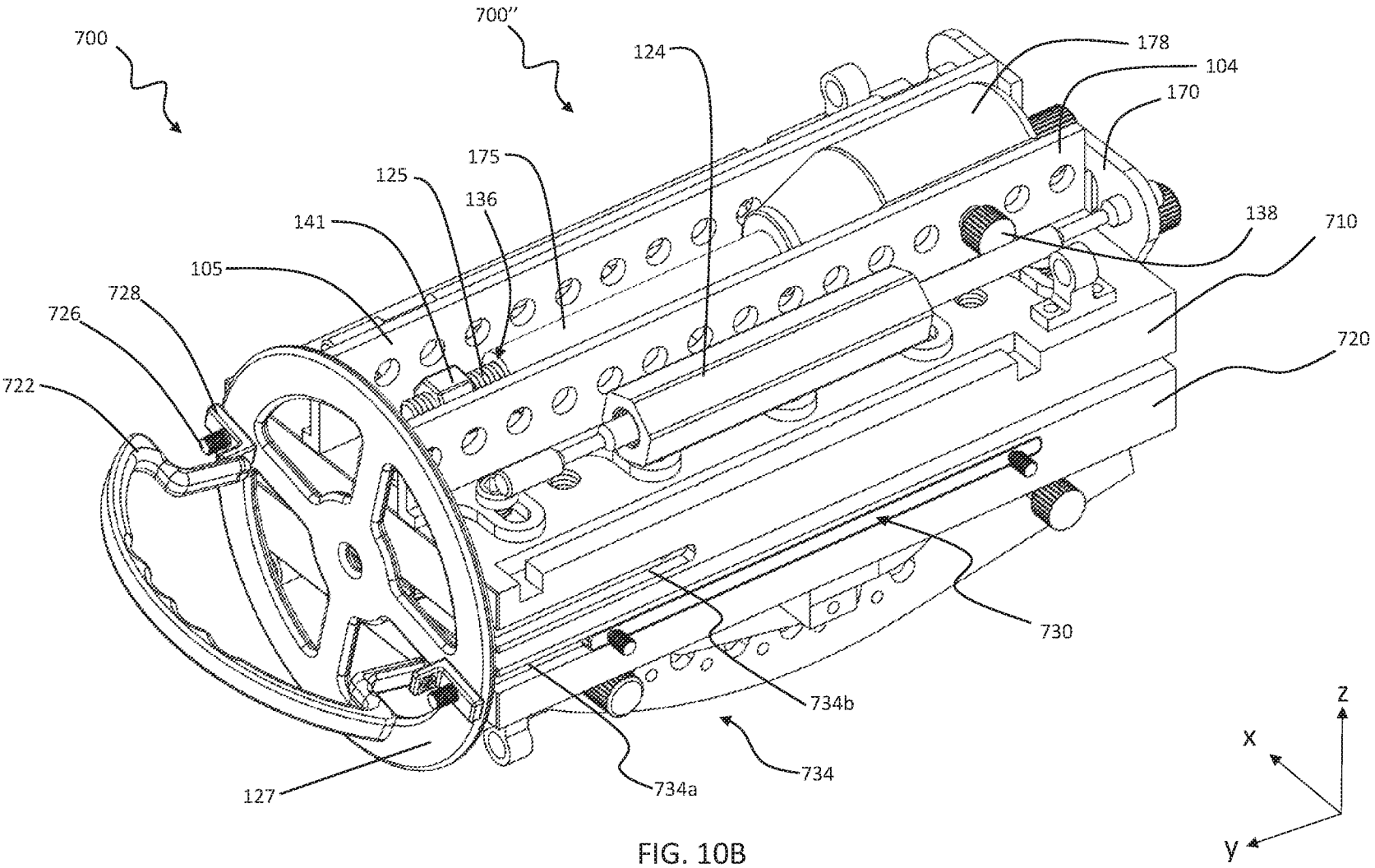
Figure 10C:
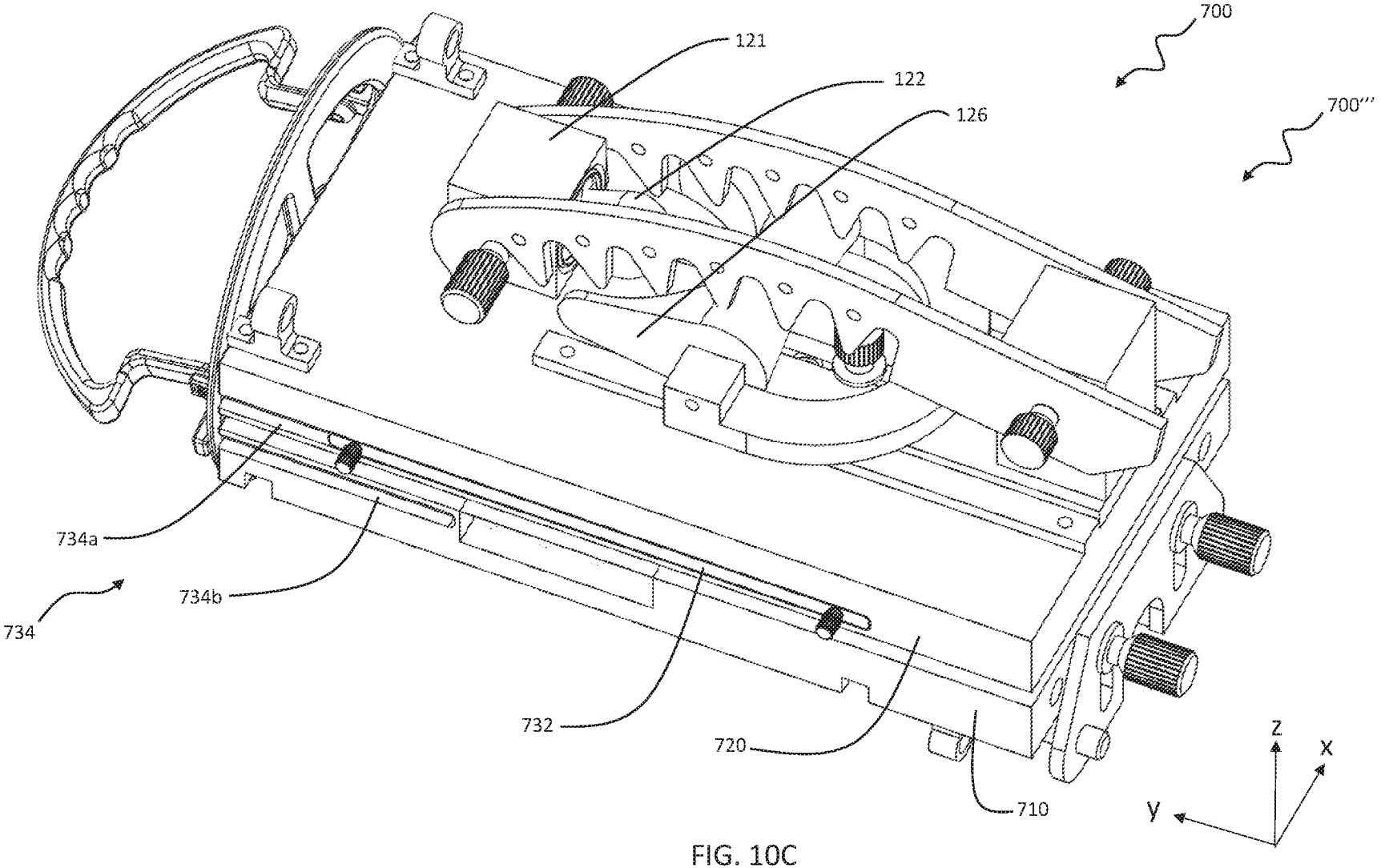

In some scenarios, it may be beneficial for a firearm disassembly and/or reassembly device to be more suited for travel. One manner of achieving this goal is to make the device compactable, such as foldable. FIGS. 10A-10C show the optional folding functionality of the device 700, which can otherwise be the same as or similar to the other devices described above. It is understood that embodiments of the devices 100,700 may or may not include such functionality and accompanying features.

In the embodiment of FIGS. 10A-10C, the base includes folding base plates 702, including a front base 710 and a rear base 720. The base plates 702 are foldable such that their bottom surfaces 710*a*,720*a* fold toward one another. A hinge 740 at the intersection of the first and second base portions 710,720, such as at the intersection of the bottoms 710*a*, 720*a*, can be used to achieve this capability. Other embodiments are possible.

Some embodiments may also include mechanisms and/or functionality for locking the first and second base portions 710,720 into place, whether in an open position such as that shown in the previous figures, or in a closed position such as the position 700" shown in FIGS. 10B and 10C (with FIG. 10A showing an intermediate position 700'). For instance, the device 700 can include one or more locking features 730. In the specific embodiment shown, the locking feature 730 includes a slide lock bar 732 and a slide lock channel 734 including a first portion 734*a* defined by the first base portion 710 and a second portion 734*b* defined by the second base portion 720. As shown, the locking feature 730 and the constituents thereof are included on a side of the base portions 710,720. FIG. 3B is also shown including the locking features, and is shown with the device in an open position. In this position, the slide lock channel 734 is in both the first and second portions 734*a*,734*b* of the slide lock channel 734, and/or spans the border between the first and second base portions 710,720. The slide lock bar 732 can be rigid. The slide lock bar 732 can substantially prevent folding of the first and second base portions relative to one another.

To unlock the locking feature 730, the slide lock bar 732 can be moved to a position where it is entirely in only one of the first and second base portions 710,720, and not in the other of the first and second base portions 710,720. For instance, the device 700 is shown in FIGS. 10B and 10C in the positions 700",700'", respectively, where the slide lock bar 730 is entirely within the second portion 734*b* of the slide lock channel 734. Because the slide lock bar 730 does not span the border between the first and second base portions 710,720, the lock is disengaged and the first and second base portions 710,720 are foldable relative to one another.

While only the second portion 734*b* of the slide lock channel 734 is shown as being long enough to accommodate the slide lock bar 732, it is understood that one or both of the slide lock portions 734*a*,734*b* can be long enough to accommodate the entire slide bar 732. While FIGS. 10B and 10C show that both sides include locking mechanisms for increased stability, in some embodiments only one side includes a locking mechanism. The slide lock bar 732 can be maintained within the slide lock channel 734 using mechanisms known in the art, such as a rail mechanism. Many different embodiments are possible, including but not limited to embodiments with different types of locking features.

It is understood that various attributes and elements of from any one embodiment can also be included in other embodiments. Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to products and systems other than percussion instruments, including but not limited to other musical instruments.

We claim:

1. A firearm disassembly and/or reassembly device, comprising:

a base;

first and second guiderails on said base; and a crank device on said base, said crank device comprising:

a crank stand;

a crank;

a push mechanism; and a crank shaft between said crank and said push mechanism, said crank shaft connected to said crank stand at a connection point;

wherein said crank is operable to move said push mechanism; and wherein an angle of said crank shaft between said crank and said push mechanism is adjustable by adjusting a location of said connection point on said crank stand.

2. The device of claim 1, wherein said first and second guiderails are substantially parallel to one another.

3. The device of claim 1, further comprising a stopper on an end of said base opposite said crank device.

4. The device of claim 1, wherein said crank device further comprises a crank base, wherein a stationary position of said crank base relative to said base is adjustable.

5. The device of claim 1, wherein said crank shaft angles downward between said crank and said push mechanism.

6. The device of claim 1, wherein said first and second guiderails extend on said base in a first direction away from said crank base; and wherein operation of said crank is configured to move said push mechanism in said first direction such that said push mechanism moves over said first and second guiderails.

7. The device of claim 1, further comprising a plunger, said plunger configured to move over said first guiderail toward said second guiderail.

8. The device of claim 7, wherein said plunger is on a plunger stand movably attached to said base.

9. The device of claim 8, wherein said plunger stand is rotatable between an upright position and a downward position.

10. The device of claim 8, further comprising a plunger rail on said base, wherein said plunger stand is attached to said plunger rail.

11. The device of claim 10, wherein said plunger rail runs in a first direction on said base, and wherein a position of said plunger stand on said plunger rail is adjustable along said plunger rail in said first direction and in a second direction opposite said first direction.

12. The device of claim 11, wherein said plunger stand is rotatable about said plunger rail between an upright position and a downward position.

13. The device of claim 1, wherein said first and second guiderails are on a top side of said base, and further comprising a base stop extending downward from said base.

14. The device of claim 1, further comprising a stopper on an end of said base opposite said crank device;

wherein said base, said first and second guiderails, and said stopper are configured to hold a slide of an inverted firearm therebetween, said firearm comprising said slide and a frame;

wherein said crank is operable to move said push mechanism such that said push mechanism pushes said frame forward, while said stopper maintains said slide.

15. The device of claim 1, wherein said base comprises first and second portions with a hinge therebetween, said crank device on said first portion and said first and second guiderails on said second portion, wherein said base is foldable at said hinge.

16. The device of claim 1, wherein said crank stand comprises two or more indexing positions, and wherein said connection point is adjustable among said two or more indexing positions.

17. The device of claim 16, wherein said crank stand comprises a sawtooth pattern forming said two or more indexing positions.

18. The device of claim 1, wherein the location of said connection point on said crank stand is adjustable over a continuous range of positions.

19. The device of claim 1, wherein said crank is operable to move said push mechanism toward or away from said first and second guiderails.

20. A firearm disassembly and/or reassembly device, comprising:

a base;

first and second guiderails running in a first direction on said base;

a plunger rail running in said first direction on said base;

a plunger attached to a plunger stand, said plunger stand movably attached to said plunger rail, wherein a position of said plunger stand on said plunger rail is adjustable along said plunger rail in said first direction and in a second direction opposite said first direction, and wherein said plunger stand is rotatable about said plunger rail between an upright position and a downward position; and a crank device on said base, said crank device comprising:

a crank;

a push mechanism; and a crank shaft between said crank and said push mechanism;

wherein said crank is operable to move said push mechanism.

* * * * *